US006236823B1

(12) United States Patent
Lee

(10) Patent No.: US 6,236,823 B1
(45) Date of Patent: May 22, 2001

(54) PHOTOSENSITIVE BELT CARTRIDGE OF ELECTROPHOTOGRAPHIC PRINTER, PHOTOSENSITIVE BELT REPLACING APPARATUS EMPLOYING THE SAME AND METHOD THEREOF

(75) Inventor: Jong-chan Lee, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/473,120

(22) Filed: Dec. 28, 1999

(30) Foreign Application Priority Data

| | | |
|---|---|---|
| Dec. 28, 1998 | (KR) | 98-59407 |
| Dec. 28, 1998 | (KR) | 98-59408 |
| Jun. 30, 1999 | (KR) | 99-25815 |
| Jul. 28, 1999 | (KR) | 99-30832 |

(51) Int. Cl.[7] ..... G03G 15/02
(52) U.S. Cl. ..... 399/116
(58) Field of Search ..... 399/26, 116, 159, 399/162, 165

(56) References Cited

U.S. PATENT DOCUMENTS

| | | | | |
|---|---|---|---|---|
| 4,766,455 | * | 8/1988 | Carter | 399/116 |
| 5,400,121 | * | 3/1995 | Foote | 399/116 |
| 5,417,322 | * | 5/1995 | Jeran et al. | 399/116 X |
| 6,014,535 | * | 1/2000 | Zenk et al. | 399/116 |
| 6,049,682 | * | 4/2000 | Goetzke et al. | 399/116 |

* cited by examiner

*Primary Examiner*—Sandra Brase
(74) *Attorney, Agent, or Firm*—Sughrue, Mion, Zinn, Macpeak & Seas, PLLC

(57) ABSTRACT

A photosensitive belt replacing apparatus of an electrophotographic printer. The disclosed photosensitive belt replacing apparatus includes: a main cartridge receiving the photosensitive belt to be replaced and installed as a continuous loop belt, and allowing the received photosensitive belt to be installed in the belt unit by being moved into an installation position of the photosensitive belt within the printer while hanging on and sliding along the insertion rails provided at the belt unit; a belt separating mechanism installed at the belt unit, and binding the photosensitive belt to the belt unit by applying a tight tension to the photosensitive belt of the main cartridge moved into the installation position and therefore allowing the photosensitive belt to remain installed in the belt unit when the main cartridge is removed from the installation position; a belt cutting mechanism installed in the printer for cutting the photosensitive belt which has been installed in the belt unit as a continuous loop belt and has been used so that the photosensitive belt can be removed; and a belt recovering mechanism for winding the photosensitive belt cut by the belt cutting mechanism and removing the photosensitive belt from the belt unit. With the photosensitive belt replacing apparatus, since the operation of replacing a photosensitive belt is nearly automatically performed, the operation can be very conveniently performed in a relatively short time, and therefore the photosensitive belt always can be installed at an exact position.

32 Claims, 24 Drawing Sheets

PHOTOSENSITIVE BELT CARTRIDGE OF ELECTROPHOTOGRAPHIC PRINTER, PHOTOSENSITIVE BELT REPLACING APPARATUS EMPLOYING THE SAME AND METHOD THEREOF

BACKGROUND OF THE INVENTION

1. Field of the Invention

The present invention relates to a photosensitive belt cartridge which receives, in a continuous loop belt state, the photosensitive belt installed in an electrophotographic printer for convenience of replacement and safe storage thereof, and a photosensitive belt replacing apparatus employing the same and a method thereof.

2. Description of the Related Art

An electrophotographic printer such as a color laser printer is provided with a photosensitive belt 10 supported by and circulating around a plurality of rollers 11, 12 and 13 installed in a main body of the printer as shown in FIG. 1. An image to be printed is developed on a surface of the photosensitive belt 10 by a predetermined developing unit 15, and after the developed image is dried while passing through a drying unit 16, the image is printed on a paper 1 at a transfer unit 14 including a transfer roller 14*a* and a fuser roller 14*b*.

Here, a unit in which the photosensitive belt 10 circulates is called a belt unit. In addition, the roller 11 of the rollers 11, 12 and 13 is a drive roller which is connected to a driving source and circulates the photosensitive belt 10, the roller 12 is a backup roller for the transfer roller 14*a*, and the roller 13 acts as a steering roller for preventing lateral movement of the photosensitive belt 10.

However, as such a photosensitive belt is used for a long time, the precision of a developed image deteriorates gradually. Therefore, when a predetermined use life has passed, the photosensitive belt must be replaced with a new one so as to continuously develop a clear image. However, in a conventional method for such replacement, a photosensitive belt formed as a continuous loop belt as mentioned above is replaced with a new one in a manner in which the photosensitive belt is adjusted to an installment position in the main body and inserted into the position directly by hand. To this end, one of the rollers 11, 12 and 13, that is, the steering roller 13 is installed to be movable as shown by an imaginary line in FIG. 1, the steering roller 13 is moved to a position shown by the imaginary line to loosen the tension of the photosensitive belt 10 during replacement, and then the photosensitive belt 10 is removed. Thereafter, the new photosensitive belt is inserted by hand, and then the steering roller 13 is moved to the original position to tighten the tension of the photosensitive belt 10.

However, since the photosensitive belt 10 has no rigid shape and is flexible, it is very troublesome and difficult in itself to replace the photosensitive belt 10 with a new one by adjusting the photosensitive belt 10 to the installation position and inserting it into the position by hand, and in addition there is a problem in that the possibility of improper installation of the new photosensitive belt may be high depending on the worker performing the replacement job. In addition, since the worker must put his hand into the printer, hold the photosensitive belt 10 and pull it out directly by hand when the photosensitive belt 10 is removed from the printer, the hand of the worker may be injured by interference with various structural members in the tight inner space of the printer.

SUMMARY OF THE INVENTION

To solve the above problems, it is an objective of the present invention to provide a photosensitive belt cartridge which is adapted so that a worker can perform the replacement of the photosensitive belt in a safe, simple and fast manner, an apparatus for replacing a photosensitive belt which employs the same, and a method thereof.

Accordingly, to achieve the above objective, there is provided a photosensitive belt cartridge of an electrophotographic printer for receiving a photosensitive belt to be installed in the electrophotographic printer including: a main cartridge which has a hollow shape, one side surface of which is open, and in which the photosensitive belt is received as a continuous loop belt; and a removable cartridge removably assembled to the main cartridge so that when the photosensitive belt is installed at a circulation position in the printer, the removable cartridge can be separated from the main cartridge and installed with the photosensitive belt in the printer, and provided with a belt recovering mechanism therein for winding the photosensitive belt from the circulation position when necessary.

In addition, to achieve the above objective, there is provided a photosensitive belt replacing apparatus of an electrophotographic printer for replacing a photosensitive belt installed in a belt unit of the printer comprising: a main cartridge receiving the photosensitive belt to be replaced and installed as a continuous loop belt, and allowing the received photosensitive belt to be installed in the belt unit by being moved into an installation position of the photosensitive belt within the printer while hanging on and sliding along insertion rails provided at the belt unit; a belt separating mechanism installed at the belt unit, and binding the photosensitive belt to the belt unit by applying a tight tension to the photosensitive belt of the main cartridge moved into the installation position and therefore allowing the photosensitive belt to remain installed in the belt unit when the main cartridge is removed from the installation position; a belt cutting mechanism installed in the printer for cutting the photosensitive belt which has been installed in the belt unit as a continuous loop belt and has been used so that the photosensitive belt can be removed; and a belt recovering mechanism for winding the photosensitive belt cut by the belt cutting means and removing the photosensitive belt from the belt unit.

In addition, to achieve the above objective, there is provided a method of replacing a photosensitive belt of an electrophotographic printer for replacing the photosensitive belt which circulates around a continuous loop track while supported by a belt unit within the printer, and on which a predetermined image is developed by a developing unit and which transfers the image to a transfer unit, including the steps of: outputting a message informing a user that it is time to replace the photosensitive belt; confirming whether the user has started to replace the photosensitive belt with respect to the message; cutting the photosensitive belt by moving a cutting blade installed in the printer so as to move across the photosensitive belt when the user selects start of replacement of the photosensitive belt; driving a removable cartridge provided with a hollow cylinder and a revolver rotatably installed in the hollow cylinder and installed in the belt unit to move and causing the revolver to wind the cut photosensitive belt between the outer circumferential surface of the revolver and the inner surface of the cylinder according to the rotation of the revolver; and removing the removable cartridge having wound the photosensitive belt from the printer. The method further comprises preparing a main cartridge in which the new photosensitive belt is received as a continuous loop belt and to which a new removable cartridge to be installed in the belt unit is removably assembled together with the photosensitive belt; inserting the main cartridge into an installation position in the printer; locking the main cartridge to the installation position; binding the received photosensitive belt to the belt unit by moving a steering roller installed in the belt unit and applying tight tension to the photosensitive belt received in the main cartridge; unlocking the main cartridge and locking the removable cartridge; and causing the photosensitive belt and the removable cartridge to be separated from the main cartridge and to remain installed in the belt unit when the main cartridge is removed from the printer.

BRIEF DESCRIPTION OF THE DRAWINGS

The above objective and advantages of the present invention will become more apparent by describing in detail preferred embodiments thereof with reference to the attached drawings, in which.

DETAILED DESCRIPTION OF THE PREFERRED EMBODIMENTS

Figure 1:
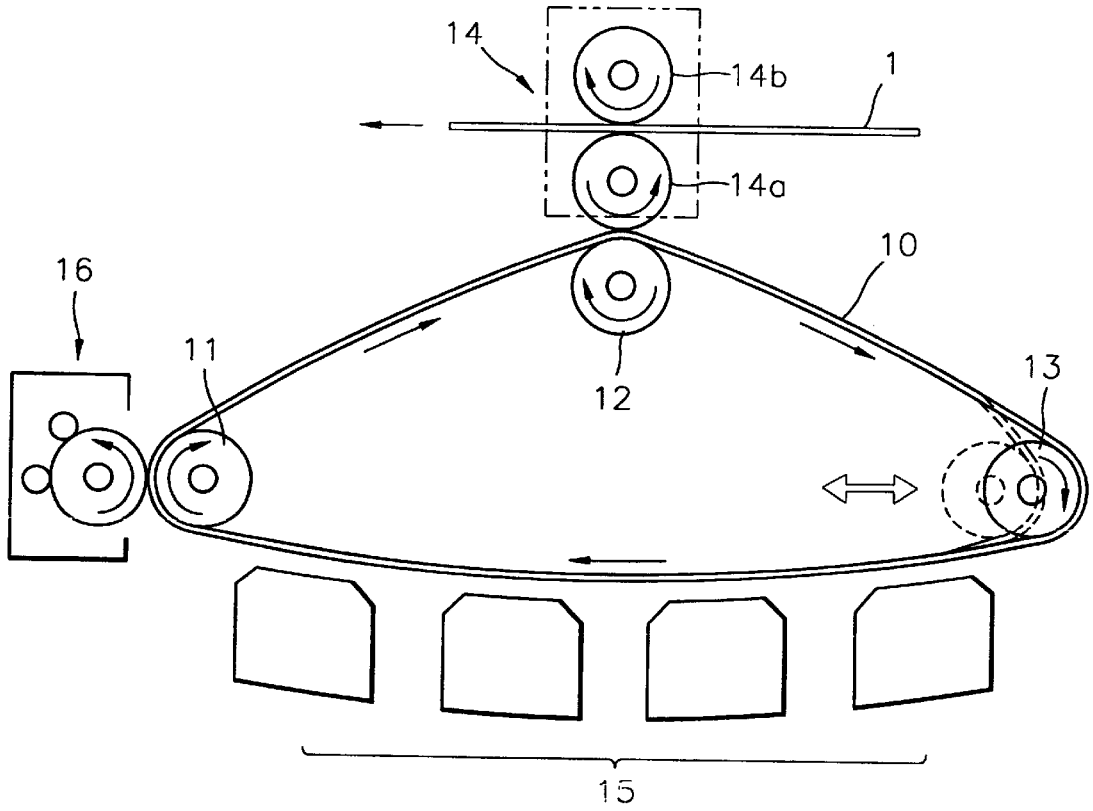
FIG. 1 is a schematic diagram illustrating essential portions of a general electrophotographic printer.
Figure 2:
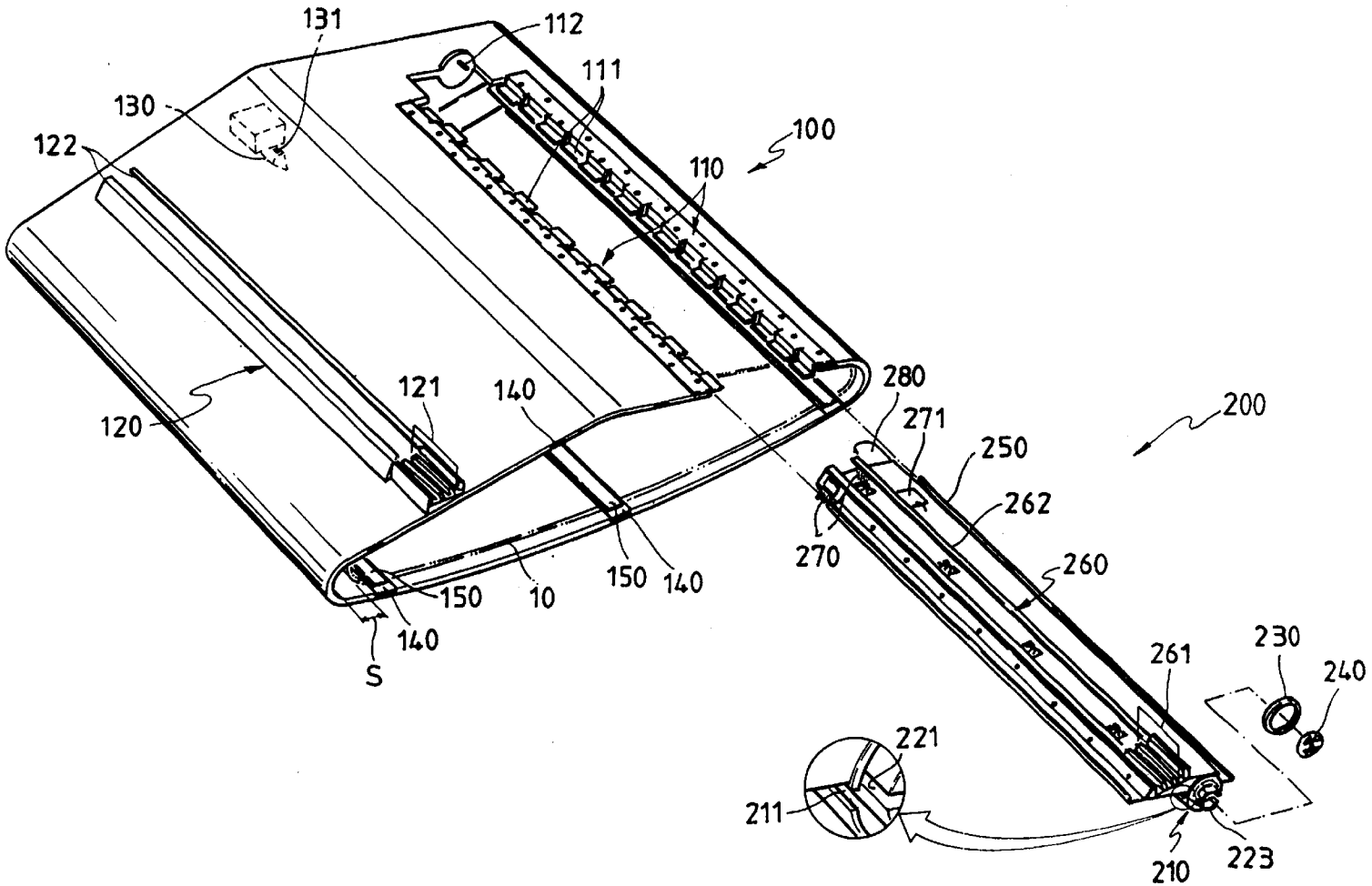
FIG. 2 is a perspective view illustrating a photosensitive belt cartridge of an electrophotographic printer according to the present invention.

FIG. 2 shows the structure of a photosensitive belt cartridge of an electrophotographic printer according to the present invention. As shown in FIG. 1, a photosensitive belt cartridge of the present invention includes a main cartridge 100 and a removable cartridge 200 which can be assembled to and separated from each other.

Figure 3A:
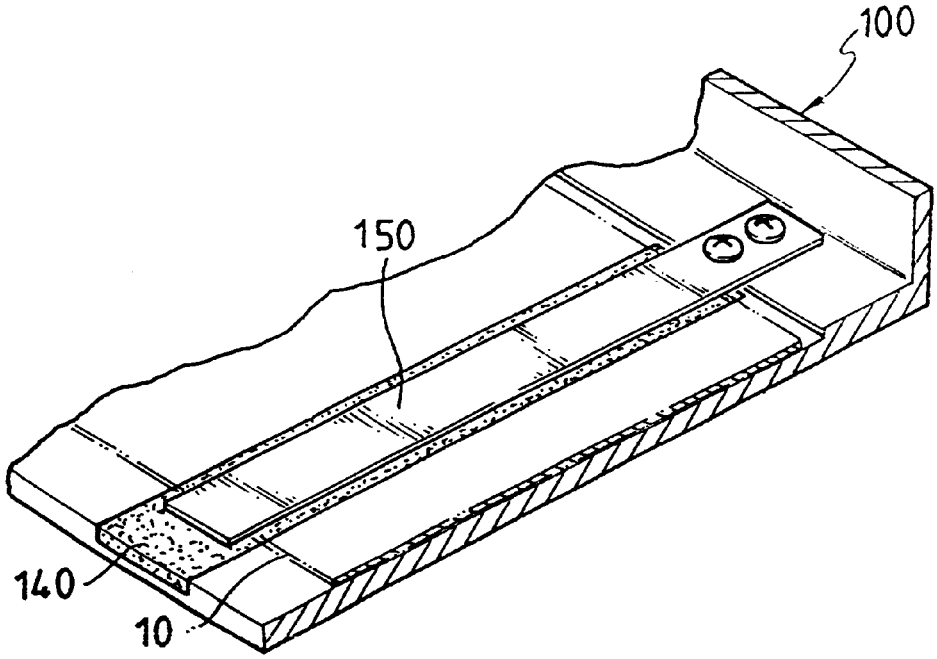
FIG. 3A is a perspective view of a portion of the photosensitive belt cartridge shown in FIG. 2 showing the structure for fixing a photosensitive belt.

The main cartridge 100 has a hollow shape, one side surface of which is open, and a photosensitive belt 10 is received in the main cartridge 100 in the same continuous loop belt state as the photosensitive belt 10 is received in a printer. To this end, as shown in FIGS. 2 and 3A, magnets 140 are intermittently embedded in the inner circumferential wall of the main cartridge 100 along the continuous loop of the photosensitive belt 10, and, in addition, plate members 150 which are to be magnetically attached to the magnets 140 are installed to extend over the corresponding magnets 140. Therefore, the photosensitive belt 10 is received in the main cartridge 100 in a continuous loop belt state in which the photosensitive belt 10 closely contacts the inner circumferential surface of the main cartridge 100 by inserting the photosensitive belt 10 between the plate members 150 and the magnets 140. On the other hand, since a virtual situation is shown in FIG. 2 for convenience sake of showing the received state of the photosensitive belt in the main cartridge 100, though the photosensitive belt 10 is shown to be received in the main cartridge 100 in a state without the removable cartridge 200, in fact, after the removable cartridge 200 is assembled to the main cartridge 100, the photosensitive belt 10 is installed at the removable cartridge 200 through first and second slots 211 and 221 which will be described later, and a cap member 230 and an elastic plate 240 are assembled to the removable cartridge 200. Therefore, the photosensitive belt 10 is supported in a continuous loop belt state by the magnets 140 and the plate members 150 with the removable cartridge 200 assembled to the main cartridge 100.

Figure 3B:
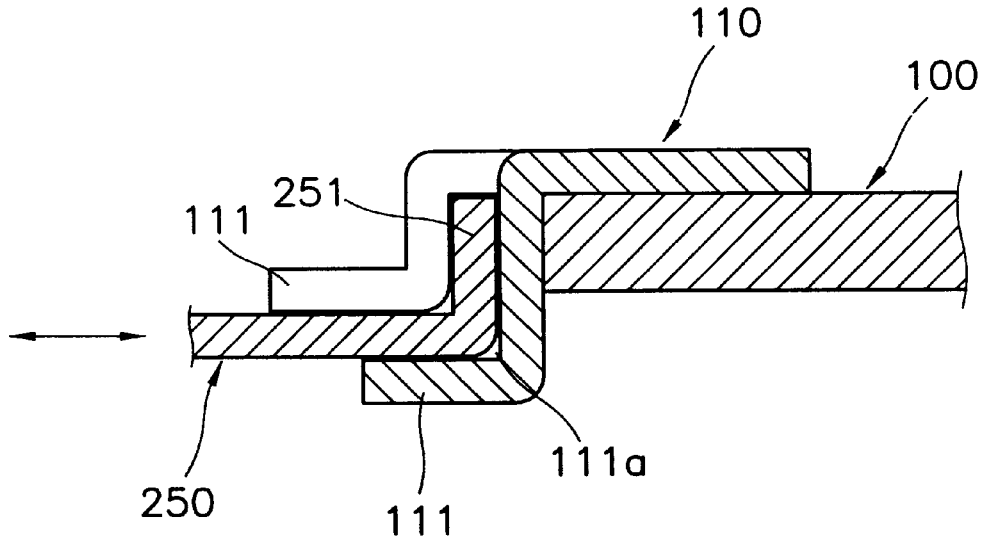
FIG. 3B is a sectional view of a portion of the photosensitive belt cartridge shown in FIG. 2 showing the structure of assembling a removable cartridge to a main cartridge.
Figure 4A:
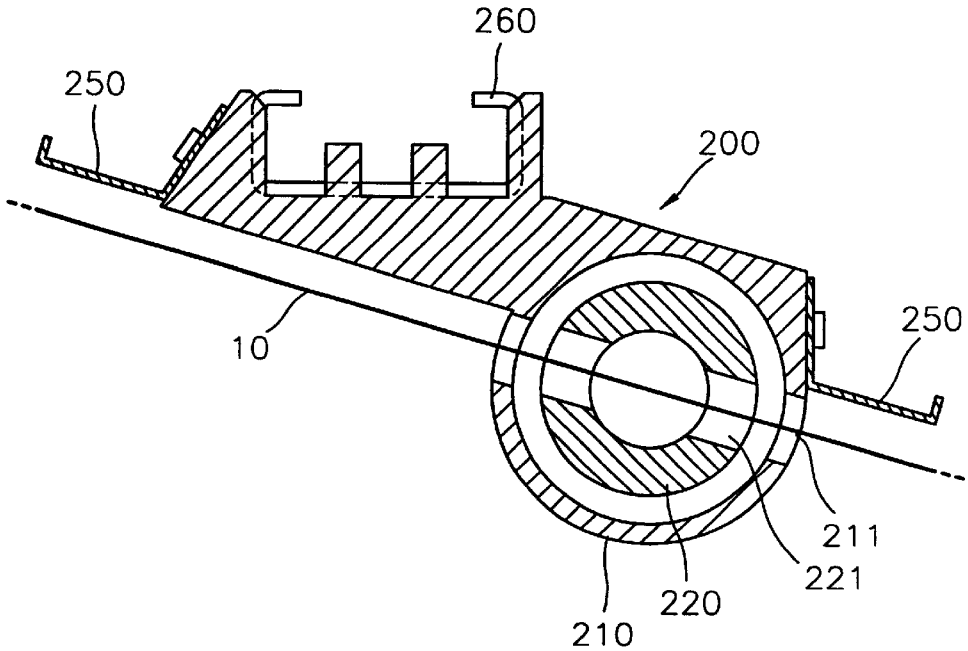
FIGS. 4A through 4C are sectional views of the removable cartridge of the photosensitive belt cartridge shown in FIG. 2 for describing the rotation operation of the revolver of the removable cartridge.
Figure 4B:
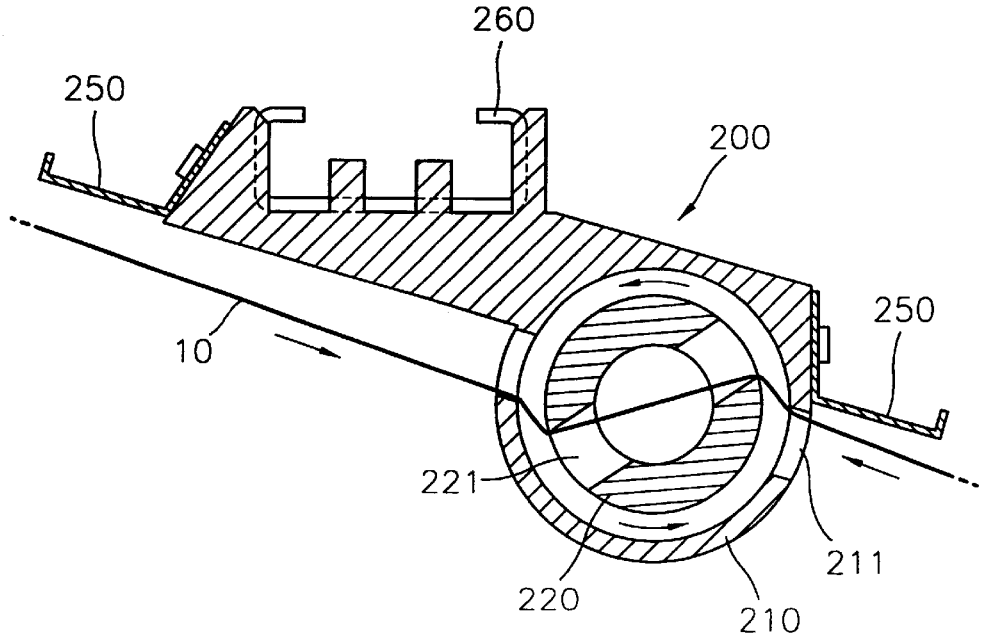
Figure 4C:
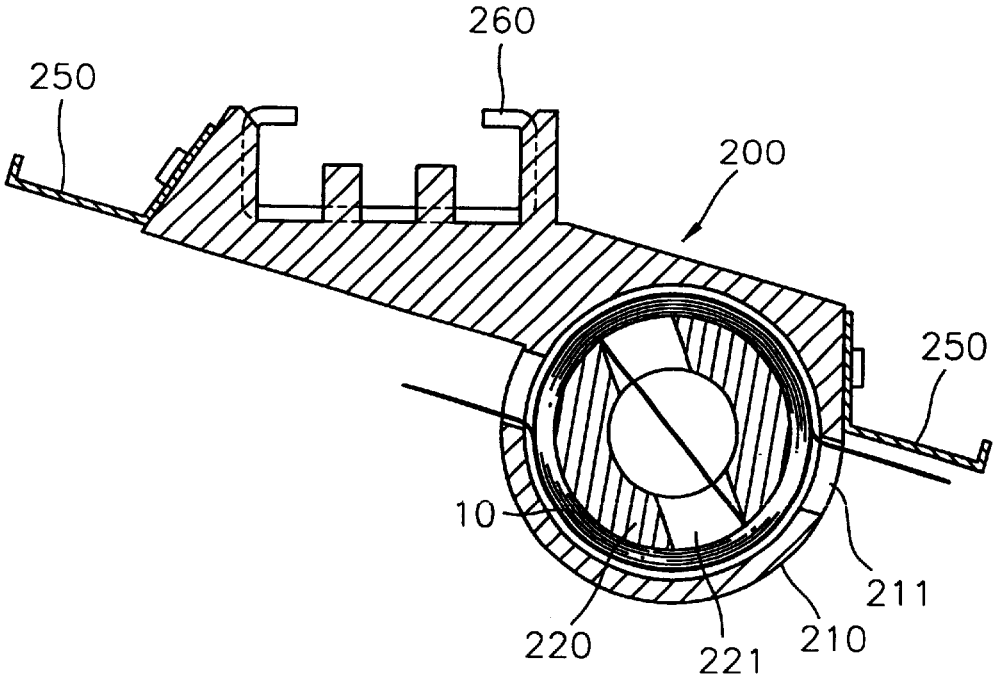

Next, the removable cartridge 200 is configured so that the removable cartridge 200 can be assembled to the main cartridge 100 when wing portions 250 of the removable cartridge 200 are inserted into stepped support rails 110 provided at the main cartridge 100. That is, each support rail 110 is formed in a shape in which a plurality of plate members 111 are bent to alternately have high and low positions, and the wing portions 250 of the removable cartridge 200 are inserted between the plate members 111 alternately having two different heights. In addition, each wing portion 250 is provided with a bent portion 251 bent at a right angle, and the bent portion 251 is configured to be inserted into a vertical space 111*a* defined by the plate members 111 bent to have different heights as shown in FIG. 3B. Therefore, the bent portion 251 restrains the removable cartridge 200 from moving in the direction of an arrow shown in FIG. 3B. On the other hand, when the main cartridge 100 is removed from the printer after the photosensitive belt 10 is installed at the circulation position within the printer, the removable cartridge 200 assembled to the main cartridge 100 as described above is separated from the main cartridge 100 and installed at a belt unit within the printer. The detailed mechanism for installing the removable cartridge 200 at the belt unit will be described later. In addition, the removable cartridge 200 is provided with a belt recovering means for winding up the photosensitive belt 100 at the circulation position when necessary. The belt recovering mechanism or means (see FIGS. 4A–4C) includes a hollow cylinder 210, a revolver 220 rotatably installed in the hollow portion of the cylinder 210, first slots 211 through which the photosensitive belt 10 can pass and which are formed through the circumferential wall of the cylinder 210, and a second slot 221 through which the photosensitive belt 10 can pass and which is formed through the revolver 220 corresponding to the first slots 211. Therefore, as shown in FIG. 4A, when the revolver 220 is stopped in a state in which the first and second slots 211 and 221 are disposed to overlap, the photosensitive belt 10 can circulate while passing through the first and second slots 211 and 221 without any interference. However, since the revolver 220 rotates with a portion of the photosensitive belt 10 inserted within the revolver 220 when the revolver 220 begins to rotate, as shown in FIG. 4B, the photosensitive belt 10 is wound into the space between the inner circumferential surface of the cylinder 210 and the outer circumferential surface of the revolver 220 as shown in FIG. 4C. Of course, such operation is performed when the photosensitive belt is replaced, and before the revolver 220 is rotated, the photosensitive belt 10 as a continuous loop belt must be cut widthwise at any one point by a belt cutting means which will be described later.

Figure 5A:
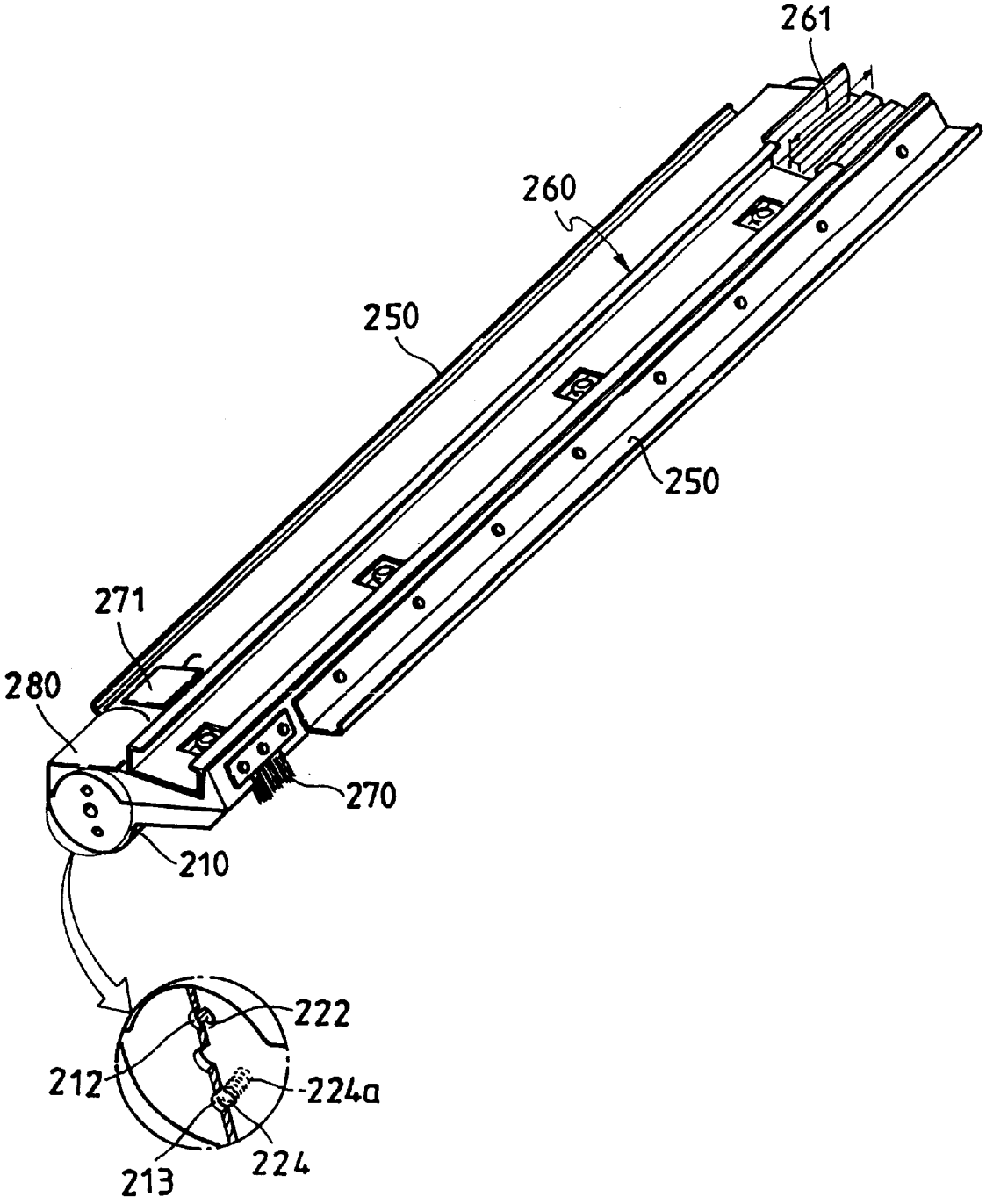
FIG. 5A is a perspective view illustrating the appearance of the removable cartridge shown in FIG. 2.
Figure 5B:
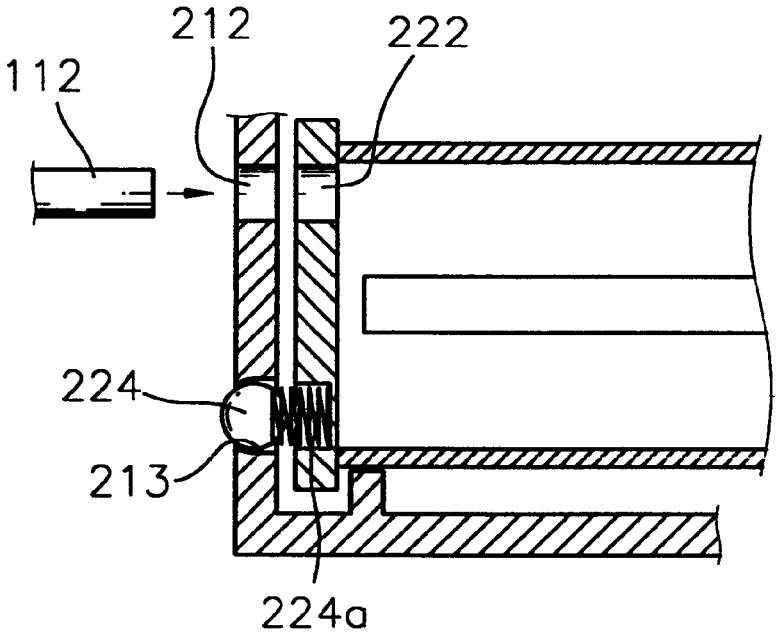
FIG. 5B is a sectional view of a portion of the removable cartridge shown in FIG. 2.
Figure 6:
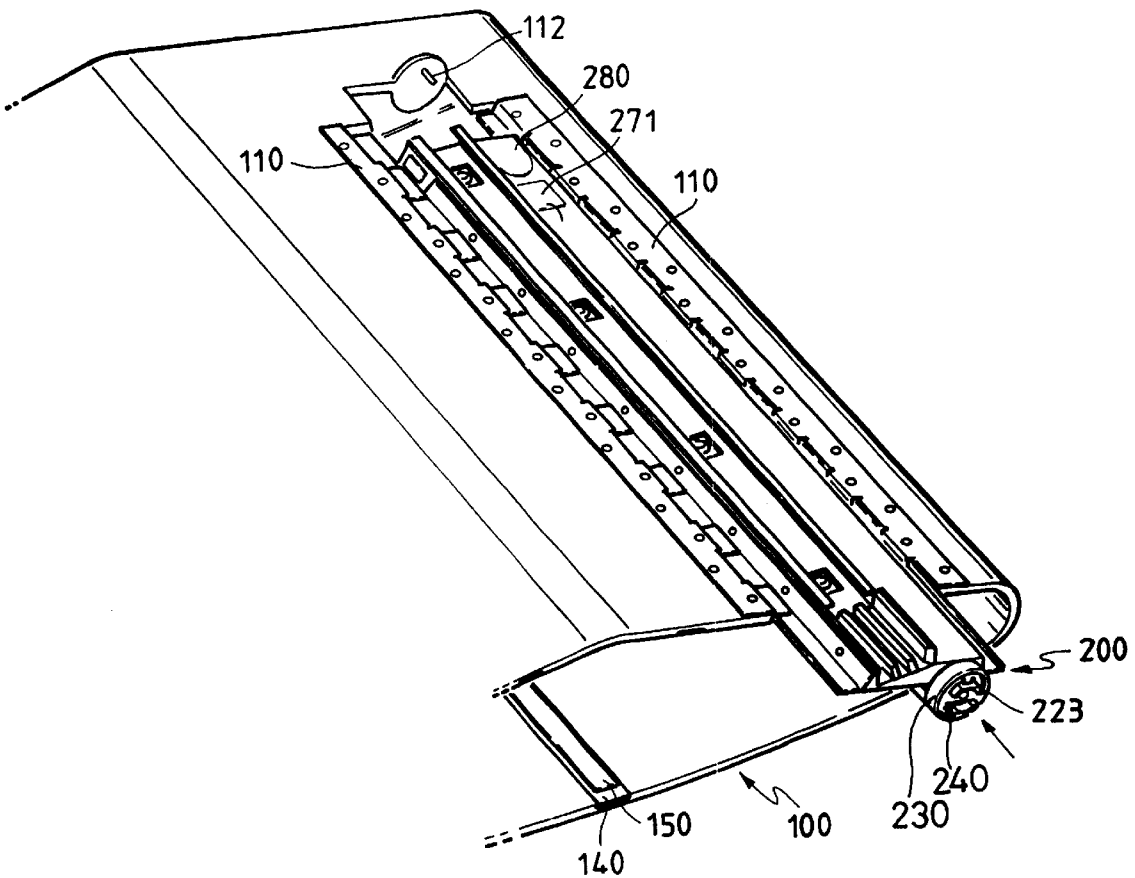
FIGS. 6 and 7 are perspective views illustrating the steps of assembling the removable cartridge to the main cartridge.
Figure 7:
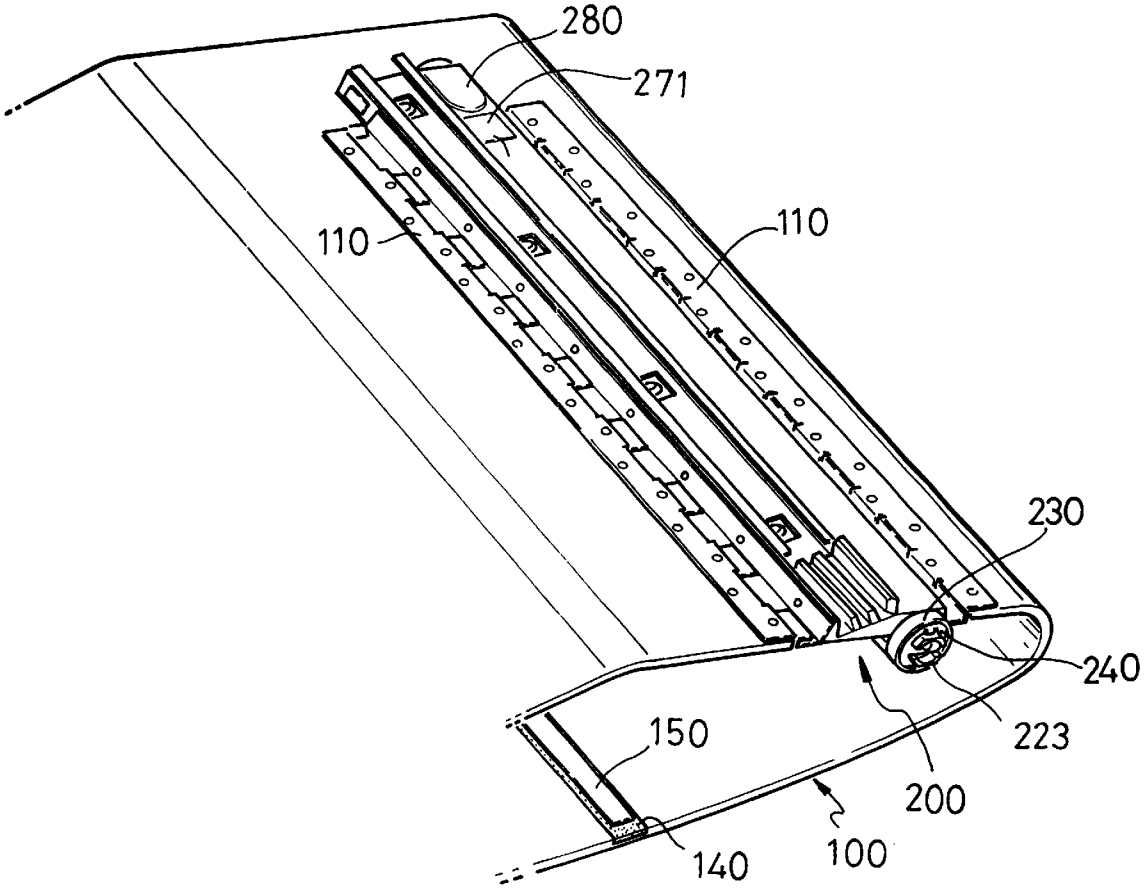

In addition, the photosensitive belt cartridge is provided with an initial position fixing mechanism or means for fixing initial positions of the first and second slots 211 and 221. The initial position fixing means is intended to fix the revolver 220 in a state in which the first and second slots 211 and 221 are overlapped to not interfere with the circulation of the photosensitive belt 10. This fixation of the revolver 220 is important for preventing the revolver 220 from moving to damage or interfere with the photosensitive belt 10 during the assembly of the photosensitive belt cartridge itself, and also important for precisely coupling the revolver 220 with a driving source installed in the printer when the removable cartridge 200 is installed in the printer together with the photosensitive belt 10. Referring to FIG. 2, a fixing pin 112 is projected at the innermost side of the support rails 100 of the main cartridge 100. In addition, referring to FIG. 5A, first and second through holes 212 and 222 into which the fixing pin 112 can be inserted are formed at one side ends of the cylinder 210 and the revolver 220, that is, the end not shown in FIG. 2. The first and second through holes 212 and 222 are overlapped as shown in FIG. 5A when the first and second slots 211 and 221 are aligned to the position in which the photosensitive belt 10 can pass therethrough. Therefore, when the removable cartridge 200 is assembled to the main cartridge 100 along the support rails 110 in this state, the fixing pin 112 is inserted into the first and second through holes 212 and 222, and accordingly the rotation of the revolver is prevented. FIG. 6 shows a state in which the removable cartridge 200 is moving in the main cartridge 100 along the support rails 110, and FIG. 7 shows a state in which the removable cartridge 200 has been assembled to the main cartridge 100. In the state shown in FIG. 7, the fixing pin 112 is inserted into the first and second through holes 212 and 222, and therefore the revolver 220 is fixed to not rotate. On the other hand, a mechanism for restraining the revolver 220 from rotating is provided in the cylinder 210 itself separately from the first and second through holes 212 and 222 and the fixing pin 112. That is, as shown in FIGS. 5A and 5B, the mechanism includes a ball 224 installed at one end of the revolver 220 and biased to be projected in an outward direction by a spring 224*a,* and a hole 213 formed at the cylinder so that the ball 224 can be elastically moved in. Of course, the ball 224 can move in the hole 213 when the revolver 220 is aligned so that the fixing pin 112 can be inserted into the first and second through holes 212 and 222, as shown in FIG. 5B. When the ball 224 moves in the hole 213 as described above, the revolver 220 does not rotate except when the revolver 220 is rotated by the power from the driving source, even after the removable cartridge 200 is separated from the main cartridge 100 and installed in the printer, that is, after the fixing pin 112 escapes from the first and second through holes 212 and 222. Therefore, the revolver 220 does not rotate except when the revolver 220 is intentionally rotated by the driving source.

Figure 12:
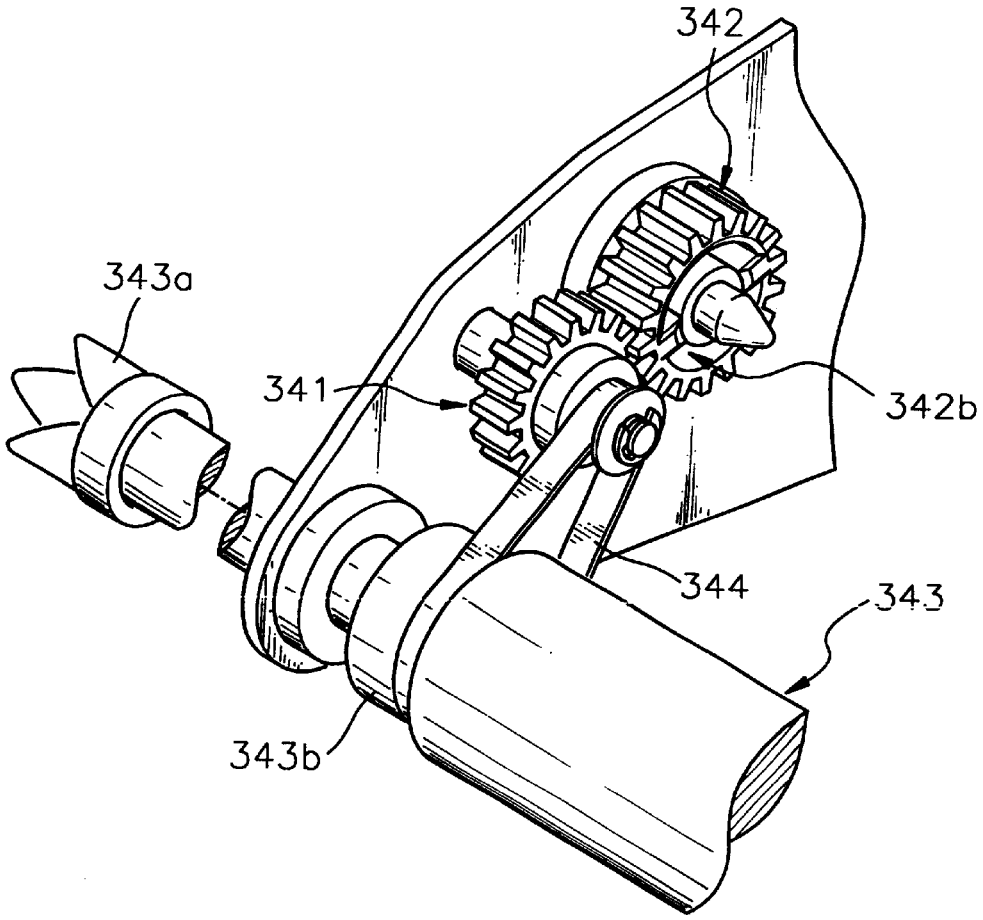
FIGS. 12 through 15 are a perspective view, an exploded view and side views illustrating a mechanism for rotating a revolver of a removable cartridge of the photosensitive belt replacing apparatus of FIG. 8.
Figure 13:
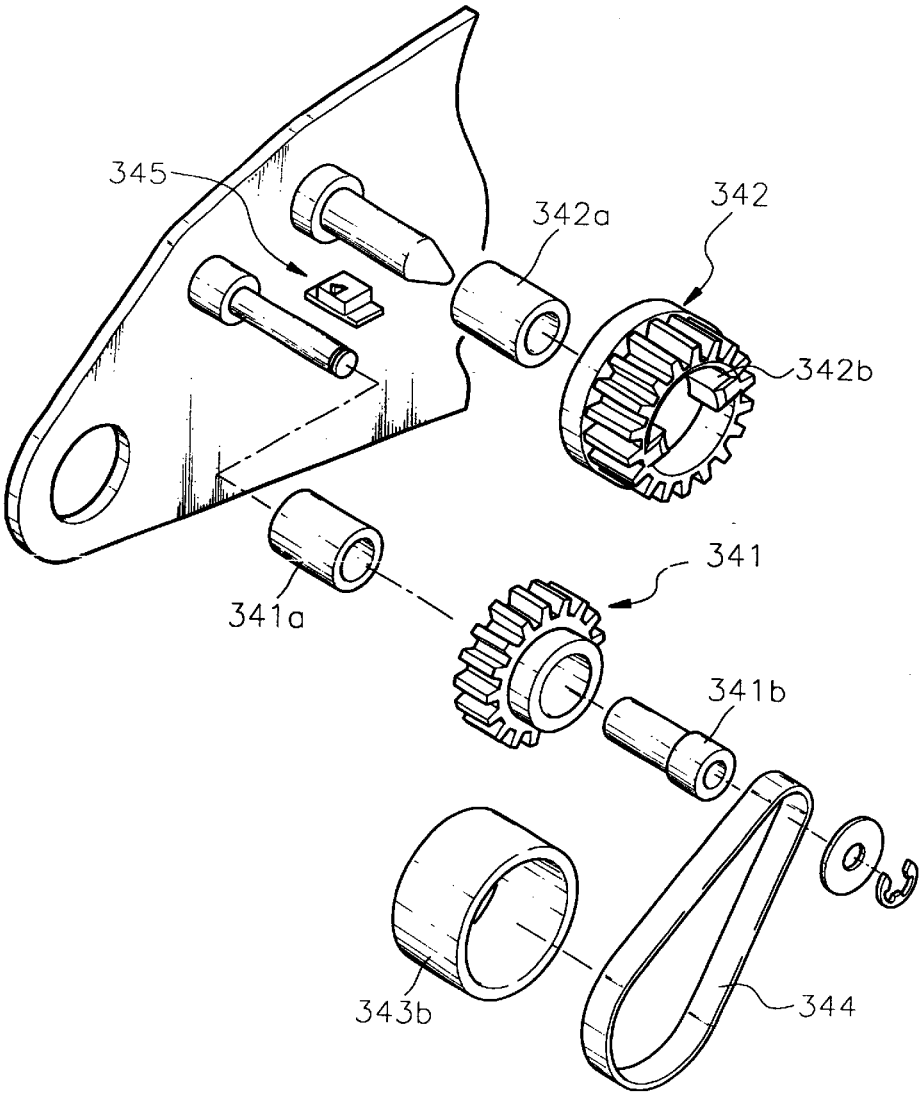

In addition, a cameo portion 223 projected in a predetermined shape is formed at the other end of the revolver 220, that is, the opposite end of the end provided with the second through hole 222. The cameo portion 223 is formed to mate with a revolver driving source side which will be described below, and an intaglio portion 342*b* (FIG. 12) which mates with the cameo portion 223 is formed at the revolver driving source side. Since the revolver 220 is in a state fixed by the initial position fixing means, the mating of the cameo portion 223 with the intaglio portion 342*b* can always be precisely attained. This mating will be described later.

Referring to FIG. 2 again, reference numeral 230 denotes a cap member, and reference numeral 240 denotes an elastic plate which supports the cap member 230 so that the cap member 230 is not biased to move outward in an axial direction. The state of attachment of the cap member 230 and the elastic plate 240 to the removable cartridge 200 is shown in FIGS. 6 and 7, and in the state the cameo portion 223 is projected outward.

Reference numeral 270 denotes a grounding brush (see FIG. 2) contacting the photosensitive belt so as to ground the photosensitive belt 10, and reference numeral 271 denotes a contacting portion connected to the grounding brush 270 and selectively contacting the grounding portion 401 (FIG. 8) installed at a main frame 400 within the printer. The grounding brush 270 is maintained in a state in which the grounding brush 270 always contacts one end portion of the photosensitive belt 10, and the contacting portion 271 contacts the grounding portion 401 as the removable cartridge 200 is installed in the printer. Therefore, the photosensitive belt 10 is grounded to the main frame 400 via the grounding brush 270, the contacting portion 271 and the grounding portion 401. Reference numeral 280 denotes a folding handle (see, e.g., FIGS. 2 and 5A) which can be pulled when the removable cartridge 200 is removed from the belt unit 300 (FIG. 8).

In addition, reference numerals 120 and 260 denote guide rails formed at the main cartridge 100 and the removable cartridge 200, respectively. The guide rails 120 and 260 are slidably mated with insertion rails 310 provided at the belt unit 300 of the printer, and the photosensitive belt cartridge can be moved into a precise belt replacing position within the printer by the mating and sliding of the guide rails 120 and 260 and the insertion rails 310. The guide rails 120 and 260 are mated with the insertion rails 310 in a manner in which L-shaped hanging ribs 122 and 262 of the guide rails 120 and 260 hang from the insertion rails 310, predetermined portions of the hanging ribs 122 and 262 are cut out at leading ends 121 and 261 of the guide rails 120 and 260 (see, e.g., FIGS. 2, 5A and 8). This cutting is intended for the convenience of fitting the guide rails 120 and 260 into the insertion rails 310 in the initial stage, and when the photosensitive belt cartridge is pushed after the cut leading ends 121 and 261 are caused to closely contact the lower surface of the insertion rails 310, the hanging ribs 122 and 262 of the guide rails 120 and 260 are naturally fitted into the insertion rails 310.

In addition, reference numeral 130 (see FIG. 2) denotes a locking projection provided with a hooking recess 131, and the locking projection 130 serves to fix the main cartridge 100 when the main cartridge 100 is moved to a photosensitive belt installing position within the printer. Details of the locking projection will be described later.

Figure 8:
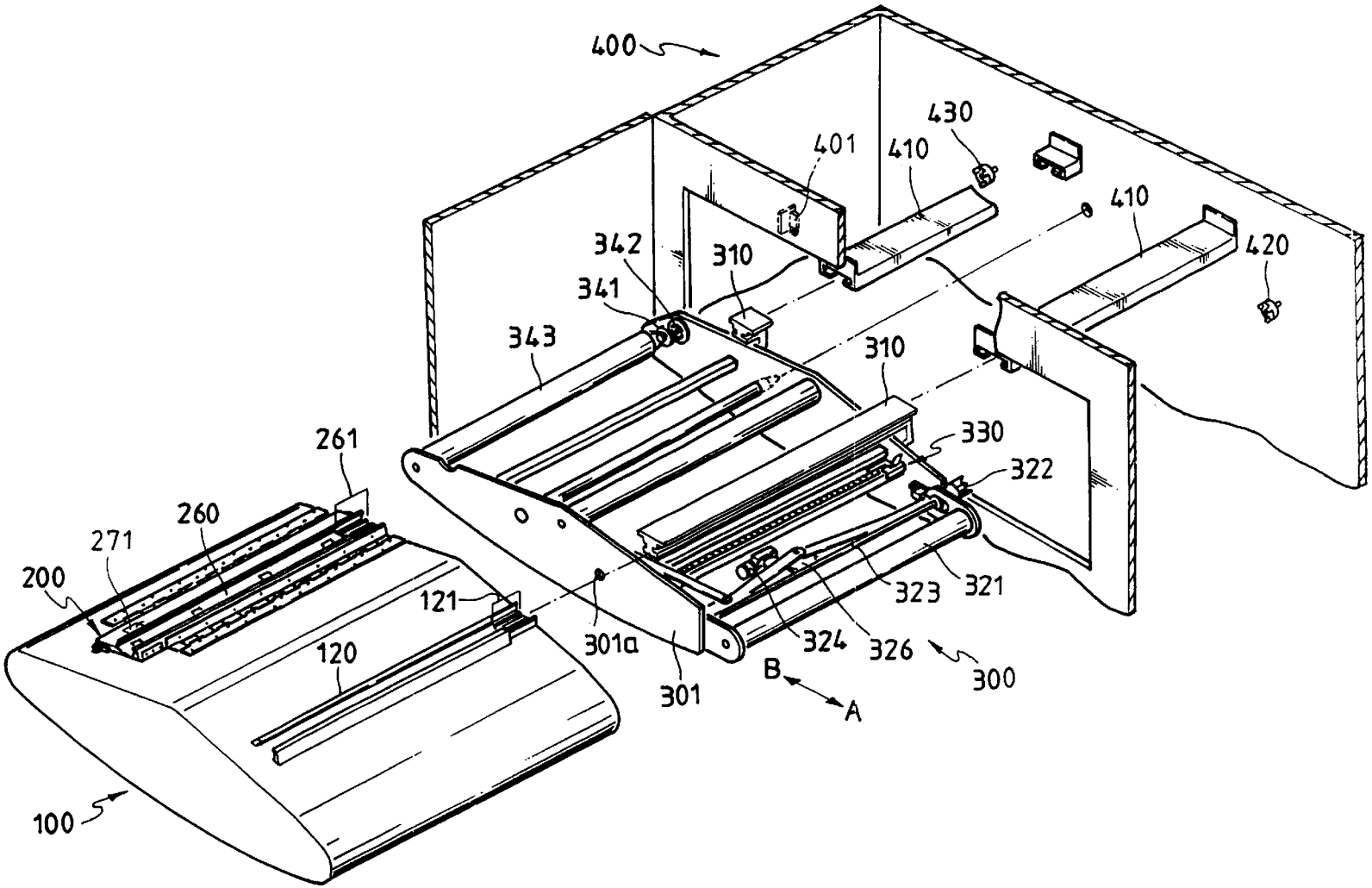
FIG. 8 is a perspective view illustrating a photosensitive belt replacing apparatus of a printer employing the photosensitive belt cartridge shown in FIG. 2.

FIG. 8 shows a schematic perspective view of an inner portion of a printer into which the photosensitive belt cartridge of the present invention is inserted.

Reference numeral 300 denotes a belt unit to which a photosensitive belt 10 is installed in a continuous loop belt state. The belt unit 300 is supported by the main frame 400 as the insertion rails 310 provided at the upper portion of the belt unit 300 are slidably inserted into the corresponding support beams 410 of the main frame 400. Then, again the guide rails 120 and 260 of the photosensitive belt cartridge are slidably assembled to the insertion rails 310.

Figure 9:
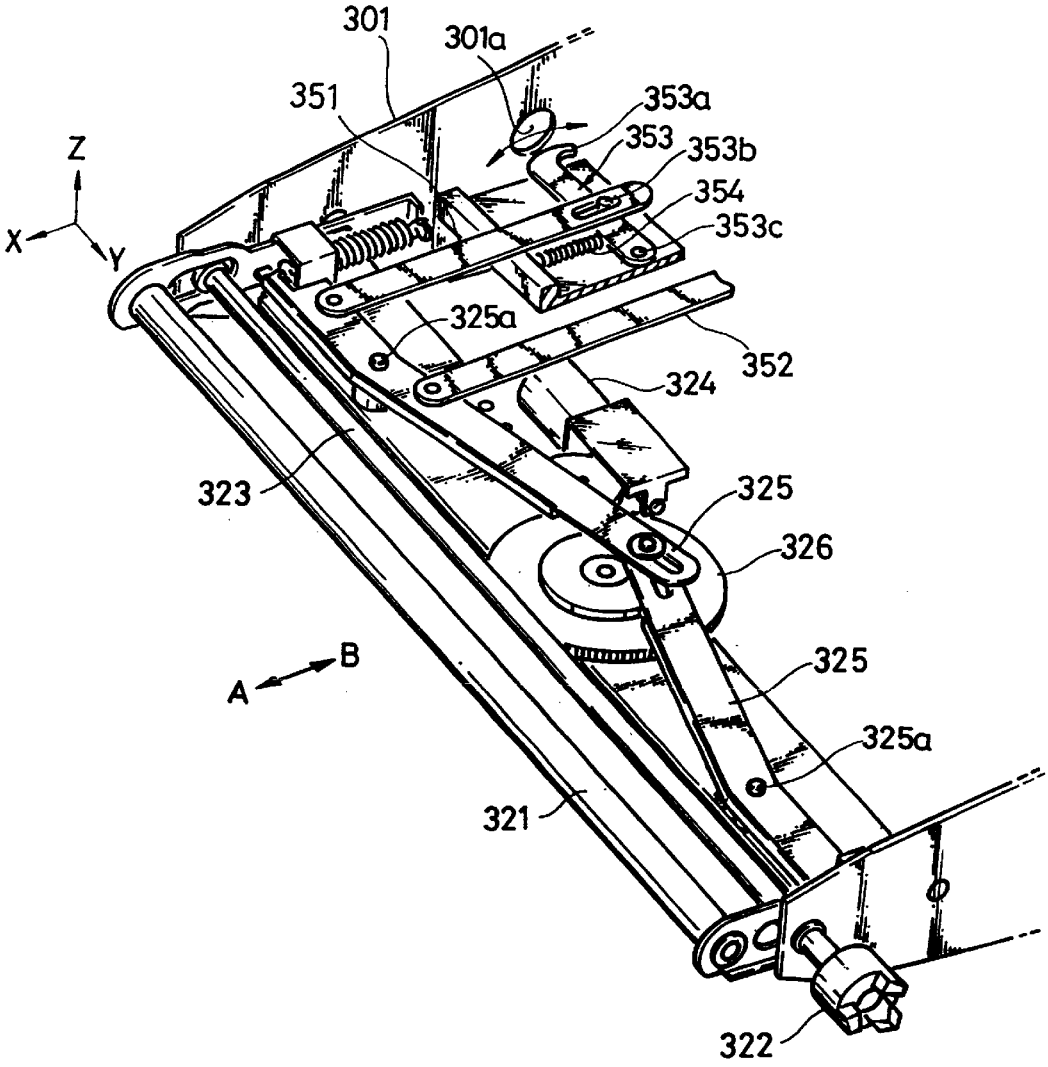
FIG. 9 is a perspective view illustrating a belt separating means of the photosensitive belt replacing apparatus of FIG. 8.

A belt separating mechanism or means is provided at the belt unit 300 so that the belt separating means applies a tension to the photosensitive belt 10 received in the main cartridge and makes the photosensitive belt 10 fit the belt unit 300 tightly, and accordingly the photosensitive belt 10 can be separated from the main cartridge. Referring to FIGS. 8 and 9, as an essential component of the belt separating means, a steering roller 321 which supports the photosensitive belt and prevents lateral movement of the photosensitive belt is installed at one side of the belt unit so that the steering roller 321 can be moved inward or outward by a pair of link members 325 pivoted by a motor 324. That is, the link members 325 are connected to a cam 326 rotated by the motor 324 and pivot around respective pivots 325*a,* and the steering roller 321 moves in the direction of arrow A or B of FIG. 9 according to the pivoting motion of the link members 325. In addition, reference numeral 322 denotes a connecting portion of a cam shaft 323 for the connection to a steering roller driving source (not shown) side coupler 420 installed at the main frame 400 (see FIG. 8), and according to the rotation of the cam shaft 323, the steering roller 321 adjusts the lateral movement of the photosensitive belt as the steering roller 321 is tilted with respect to the Y-Z plane of FIG. 9. Since the operation of adjusting lateral movement of the photosensitive belt 10 and the movement of the steering roller by a slide mechanism as described above is disclosed in detail in Korean Patent Application No. 99-9179 (Apparatus for Adjusting a Photosensitive Belt of a Printer filed on Mar. 18, 1999) filed by the applicant of this invention, a detailed description thereof is omitted here. Consequently, though the tension applied to the photosensitive belt 10 installed around the belt unit is loosened when the steering roller 321 is moved in the direction of arrow B, a tight tension is applied to the photosensitive belt 10 by the pressing force of the steering roller 321 when the steering roller 321 is moved in direction the opposite of arrow A and presses against the photosensitive belt 10. Therefore, the main cartridge 100 is moved in the printer when the steering roller 321 has been moved inward in the direction of arrow B, and then the steering roller 321 is moved in the direction of arrow A and a tight tension is applied to the photosensitive belt 10 received in the main cartridge 100. Thereafter, when the main cartridge 100 is removed, the photosensitive belt 10 remains in the belt unit 300. A spacing in the main cartridge indicated by reference symbol S of FIG. 2 denotes a spare space enabling the steering roller 321 to move so as to apply a tension to the photosensitive belt 10.

Figure 10A:
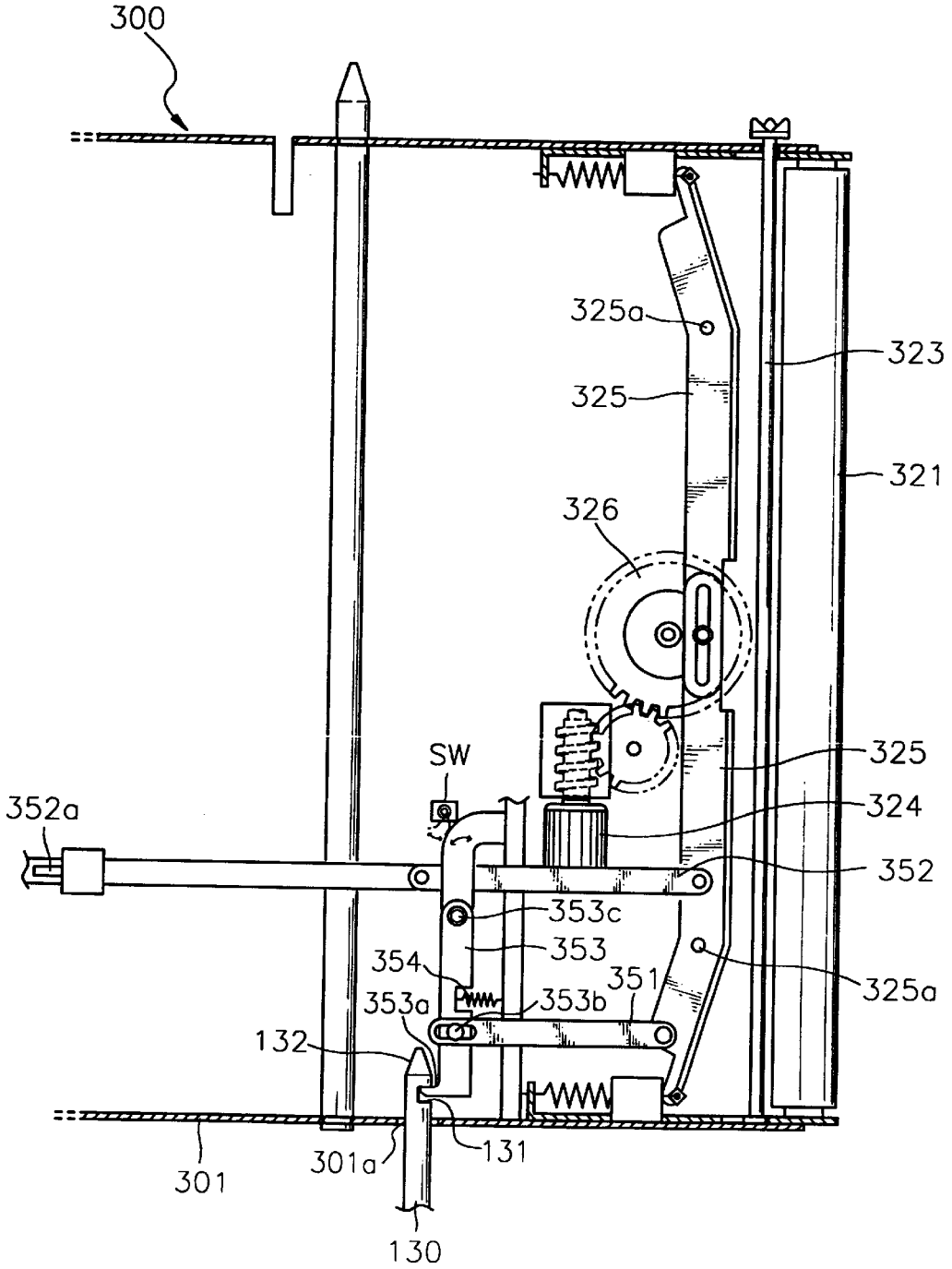
FIGS. 10A, 10B, 11A and 11B are top views and side views of portions of the photosensitive belt replacing apparatus of FIG. 8 for describing the operation of a main cartridge locking means and a removable cartridge locking means of the apparatus.

On the other hand, first and second levers 351 and 352 are connected to one of the pair of link members 325 and are disposed to have the pivot 325*a* therebetween. Therefore, according to the pivoting motion of the link member 325, the two levers 351 and 352 move in opposite directions to each other. That is, the levers 351 and 352 move in a manner in which when one lever is pulled, the other is pushed. A pivoting piece 353 elastically biased by a compression spring 354 is assembled to the first lever 351. The pivoting piece 353 is subjected to an elastic force of the compression spring 354 which causes the pivoting piece to rotate around a hinge point 353*c* in a clockwise direction in FIG. 9, and in order to rotate the pivoting piece 353 counterclockwise, a connecting pin 353*b* of the pivoting piece 353 must be pulled by moving the first lever 351 in the direction of arrow A. A hole 301*a* is formed in the vicinity of the pivoting piece 353 at a front frame 301 of the belt unit 300, and the above-described locking projection 130 of the main cartridge 100 is inserted into the very hole 301*a*. That is, when the main cartridge 100 is moved in the printer along the insertion rails 310, the locking projection 130 formed in the main cartridge 100 is inserted into the hole 301*a,* and then the hooking recess 131 of the locking projection 130 is elastically hooked by a hook portion 353*a* of the pivoting piece 353. The result of this operation is schematically shown in FIG. 10A. In other words, as the locking projection 130 is inserted into the hole 301*a,* the hook portion 353*a* is pushed along the conical surface of the conical leading end 132, again moved into the hooking recess 131 by the elastic force of the compression spring 354 and hooks the hooking recess 131. Accordingly, the main cartridge 100 is in a locked state in which the main cartridge 100 cannot escape from the inside of the printer.

Figure 11A:
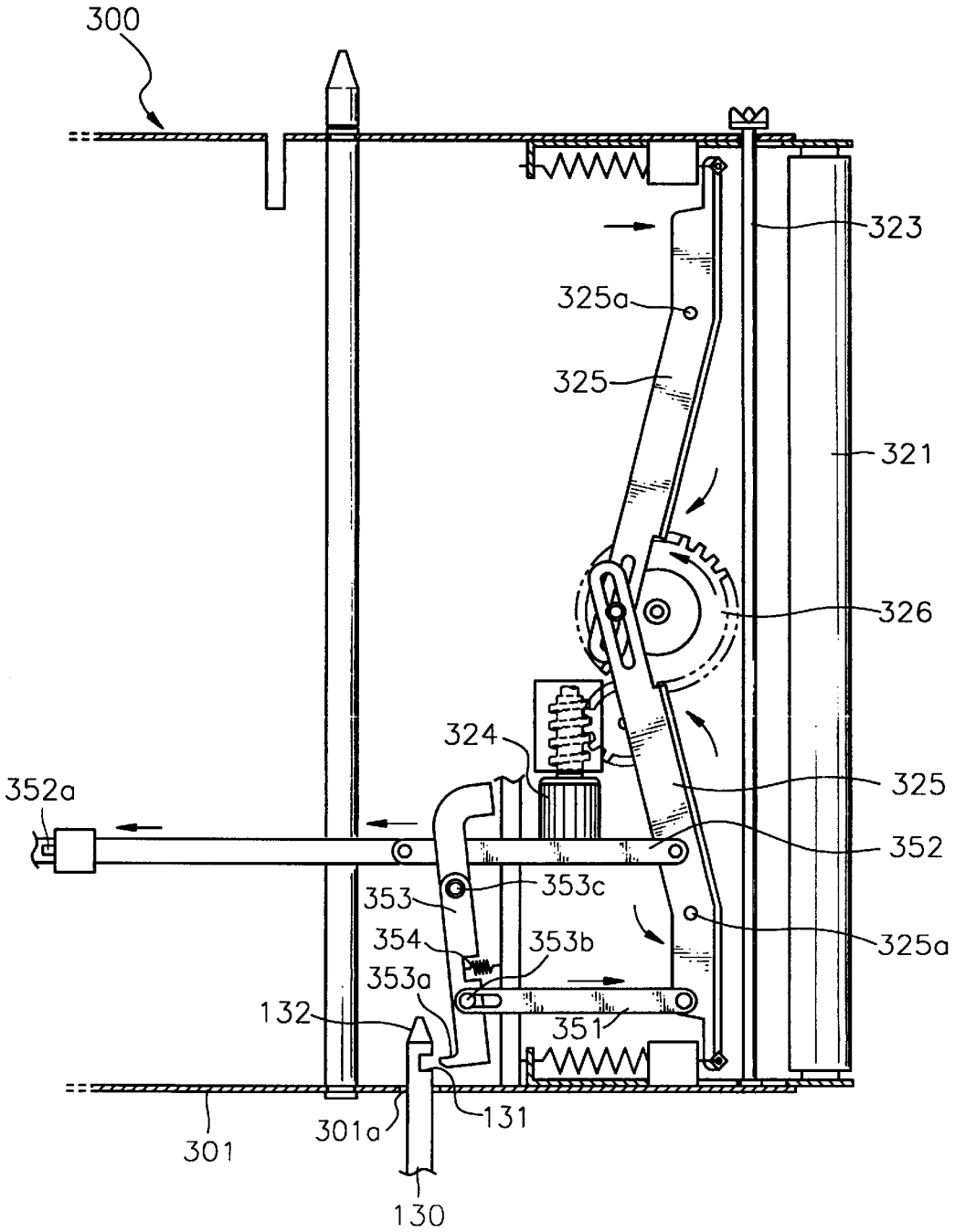

In order to unlock the main cartridge 100, the pivoting piece 353 is pivoted by moving the first lever 351, as shown in FIG. 11A, so that the hook portion 353*a* can be freed from the hooking recess 131. In this state, the main cartridge 100 can be removed from the printer without any obstruction.

Figure 10B:
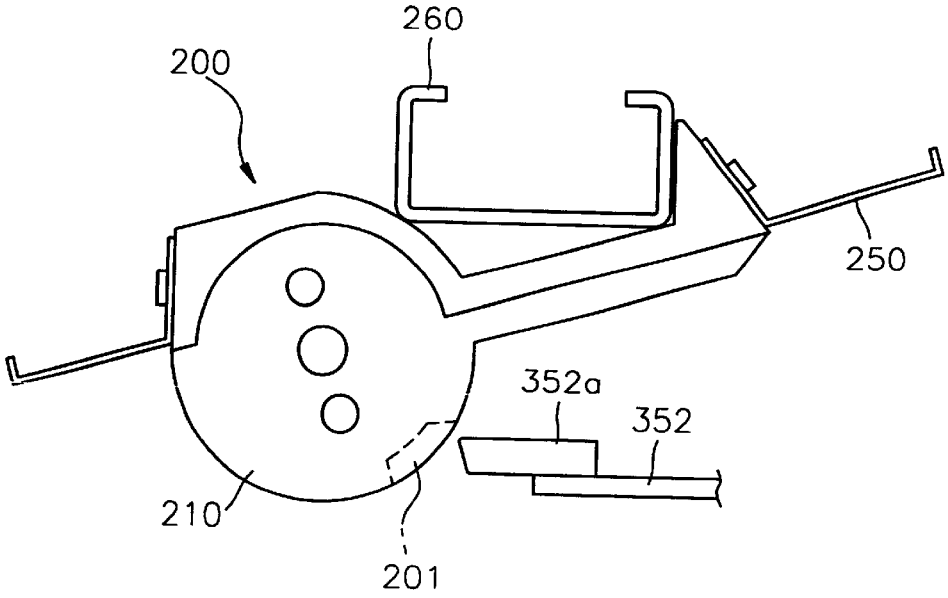
Figure 11B:
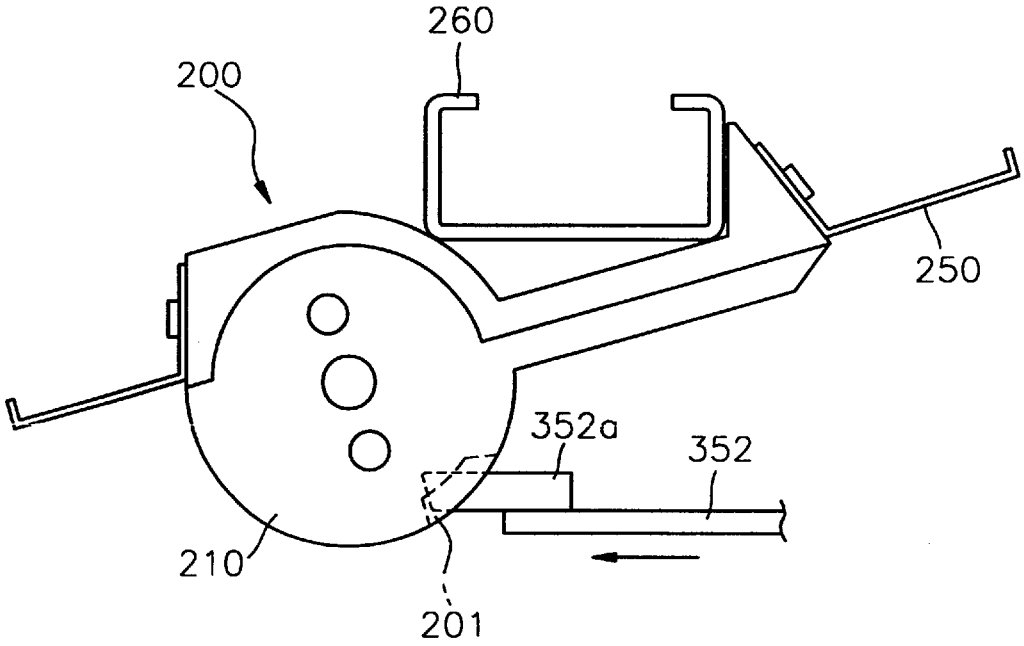

The second lever 352 is a component of a removable cartridge locking mechanism or means for separating the removable cartridge 200 from the main cartridge 100. Referring to FIGS. 10A, 10B, 11A and 11B, a groove 201 is formed at the outer circumferential surface of the cylinder 210 of the removable cartridge 200. In addition, a locking piece 352*a* which can be inserted into the groove 201 is provided at an end of the second lever 352. The locking piece 352*a* is inserted into or freed from the groove 201 in accordance with the pivoting motion of the link member 325. Therefore, in a state in which the locking piece 352*a* is not inserted into the groove 201, as shown in FIGS. 10A and 10B, the removable cartridge 200 cannot be separated from the main cartridge 100 and moves integrally with the main cartridge 100. However, as shown in FIGS. 11A and 11B, when the locking piece 352*a* is inserted into the groove 201 as the second lever 352 is moved by the pivoting motion of the link member 325, the removable cartridge 200 remains locked in place when the main cartridge 100 is removed from the printer.

Figure 14:
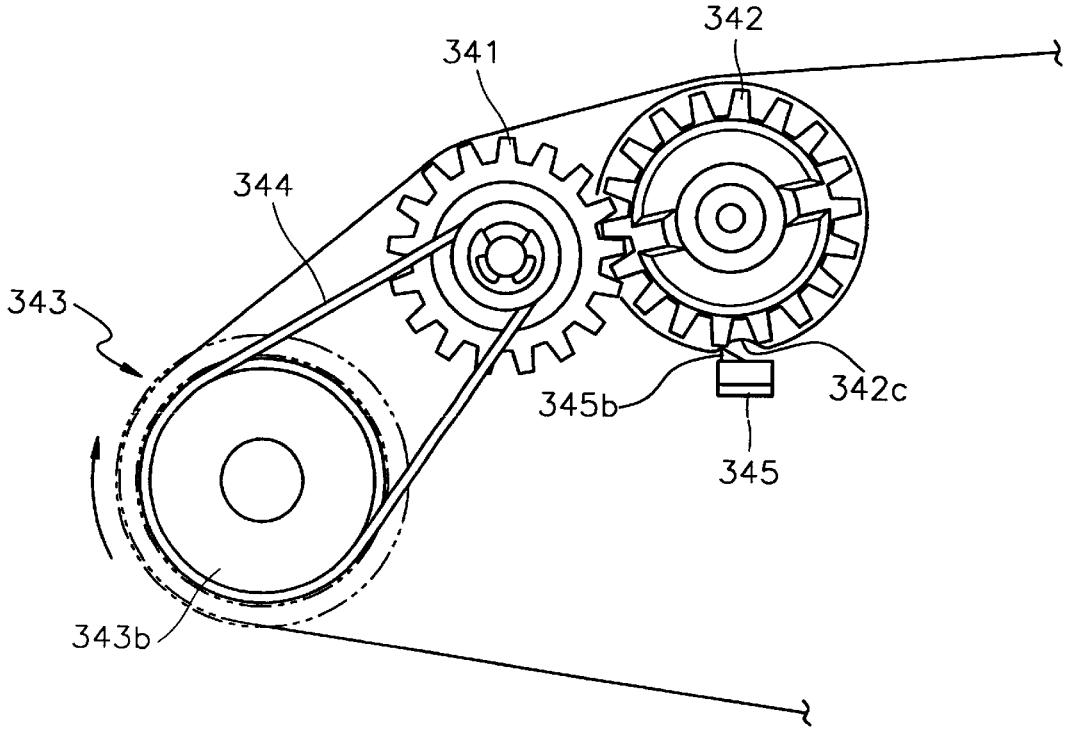
Figure 15:
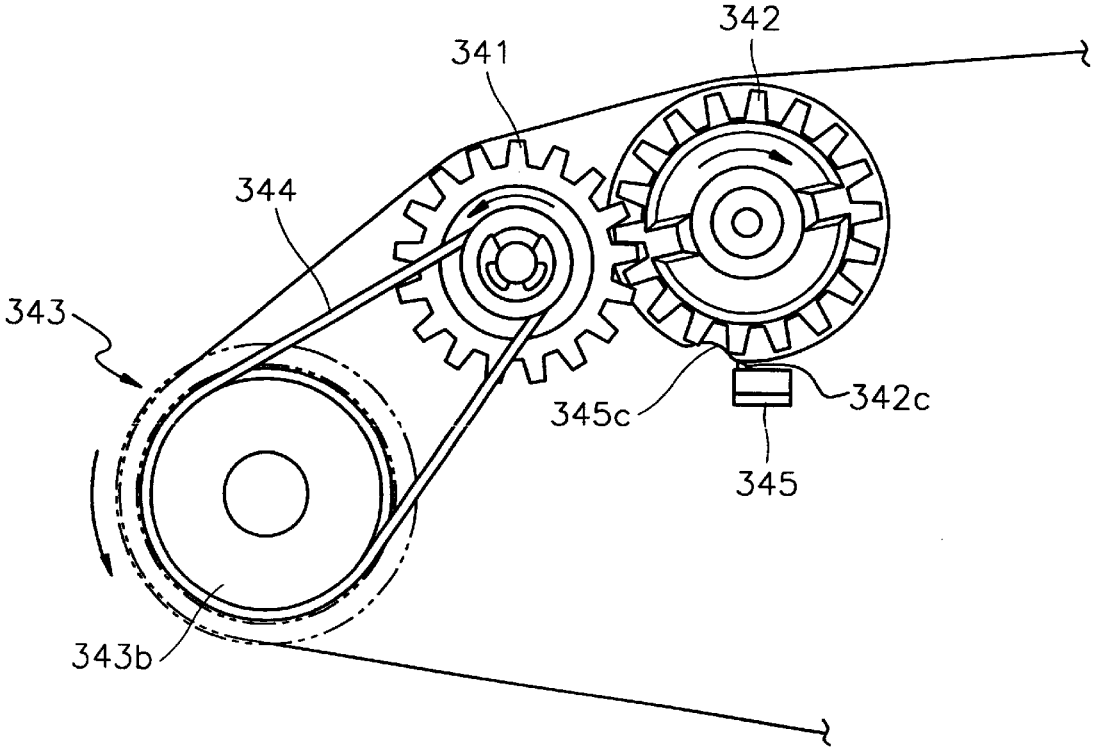

Referring to FIG. 8 and FIGS. 12 through 15, a revolver driving source is provided at the belt unit 300 for rotating the revolver 220 after the removable cartridge 200 is installed in the printer. Reference numeral 343 denotes a drive roller for circulating the photosensitive belt around the belt unit 300, and a connecting portion 343*a* which is connected to a driving source (not shown) side coupler 430 installed at the main frame 400 is provided at the rotating shaft of the drive roller 343. Therefore, the driving power of the driving source is transferred to the drive roller 343 via the connecting portion 343*a,* and rotates the drive roller 343*a* to cause the photosensitive belt to circulate. A first gear 341 and a second gear 342 which are mechanically connected to the drive roller 343 by a timing belt 344 are provided at the belt unit 300. The timing belt 344 is wound and circulated around a driving pulley 343*b* fitted on the driving roller 343 and a driven pulley 341*b* installed on the rotating shaft of the first gear 341, and accordingly the torque of the drive roller is transferred to the first gear 342. Again, the first gear 341 meshes with the second gear 342. In addition, one-way bearings 341*a* and 342*a* are installed on the shafts of the first and second gears 341 and 342, respectively, the power is transferred in only one rotation direction. That is, when the drive roller 343 rotates clockwise as shown in FIG. 14, the power is transferred to the driven pulley 341*b* via the timing belt 344 to similarly rotate the driven pulley 341*b* clockwise. However, since the one-way bearing 341*a* of the first gear 342 does not transfer the clockwise rotation, the driven pulley 341*b* runs idle and the first gear 341 itself stays in a stopped state. In addition, the one-way bearing 342*a* of the second gear 342 serves to lock the second gear 342 so that the second gear 342 may not rotate counterclockwise. Therefore, the first gear 341 meshing with the second gear 342 is strictly restrained from rotating clockwise. However, when the drive roller 343 rotates counterclockwise, the driven pulley 341*b* rotates counterclockwise by the timing belt 344, and the first gear 341 rotates counterclockwise via the one-way bearing 341*a*. Accordingly, the second gear 342 meshing with the first gear 341 rotates clockwise. In addition, the intaglio portion 342*b* which has a shape of mating with the above described cameo portion 223 of the revolver 220 is formed at the second gear 342. Since the cameo portion 223 of the revolver 220 is mated with the very intaglio portion 342*b* of the second gear 342, the power connection between the revolver driving source and the revolver is attained. Therefore, when the photosensitive belt is circulated as in a print mode, the drive roller 343 is rotated clockwise and circulates the photosensitive belt with the first and second gears 341 and 342 not rotated, and when the revolver 220 need be rotated so as to recover the photosensitive belt, the drive roller 343 is rotated counterclockwise to transfer the driving power to the first and second gear 341 and 342, and accordingly the revolver 220 is rotated.

Since the revolver 220 of the removable cartridge 200 is fixed to not rotate by the above-described initial position fixing means before the revolver 220 is mated with the second gear 342, the cameo portion 223 of the revolver 220 is maintained at the same position before the revolver 220 is mated with the second gear 342. However, when the second gear 342 to be mated with the revolver 220 is left to move freely, the fixation of the revolver 220 has no meaning. Therefore, in order to keep the second gear 342 the same position, a groove 342*c* for adjusting the position of the second gear 342 is provided in the vicinity of the second gear 342, and a sensor 345 is installed for sensing the position of the 342*c*. When a lever 345*a* of the sensor 345 is entrapped into the groove 342*c*, the second gear 342 is positioned at a position in which the cameo portion 223 of the revolver 220 is exactly mated with the intaglio portion 342*b* of the second gear 342. Therefore, the revolver 220 can always be exactly connected to the revolver driving source.

Figure 16:
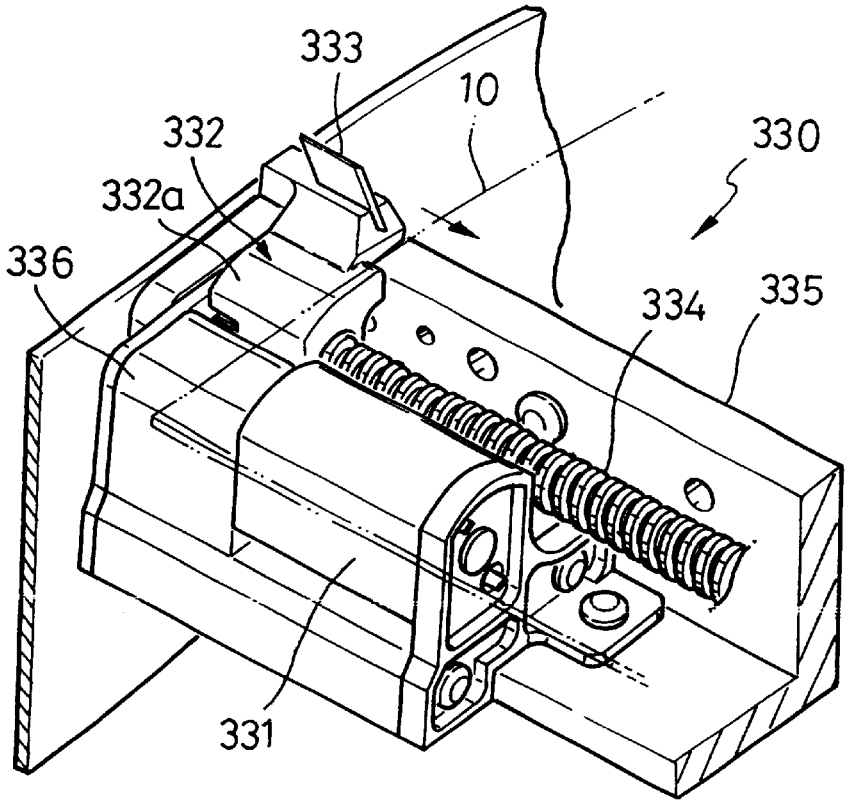
FIG. 16 is a perspective view illustrating a belt cutting means of the photosensitive belt replacing apparatus of FIG. 8.

Referring to FIGS. 8 and 16, a belt cutting means 330 is provided at the belt unit 300 for cutting the photosensitive belt 10, after having been used for its useful life, widthwise before the photosensitive belt is wound around the removable cartridge 200.

The belt cutting mechanism or means 330 includes a lead screw 334 rotated by a driving motor 331, a movable block 332 installed on the lead screw 334 to be movable according to the rotation of the lead screw 334, and a cutting blade 333 installed on the movable block 332. Reference numeral 335 denotes a supporting slide, and the movable block 332 slides back and forth with one side portion of the movable block 332 seated on the upper surface of the supporting slide 335. In addition, the geared portion between the driving motor 331 and the lead screw 334 is enclosed by a cover 332*a* of the movable block 332 and a case 336, the cover 332*a* and the case 336 serve to prevent the power transferring geared portion from being dirtied by a developer liquid dropped from the photosensitive belt 10, various dirts generated in the printer or the like. In the above configuration, when the driving motor 331 rotates the lead screw 334, the movable block 332 is moved across the photosensitive belt 10, and, at this moment, the cutting blade 333 installed on the movable block 332 cuts and passes across the photosensitive belt 10.

Figure 17:
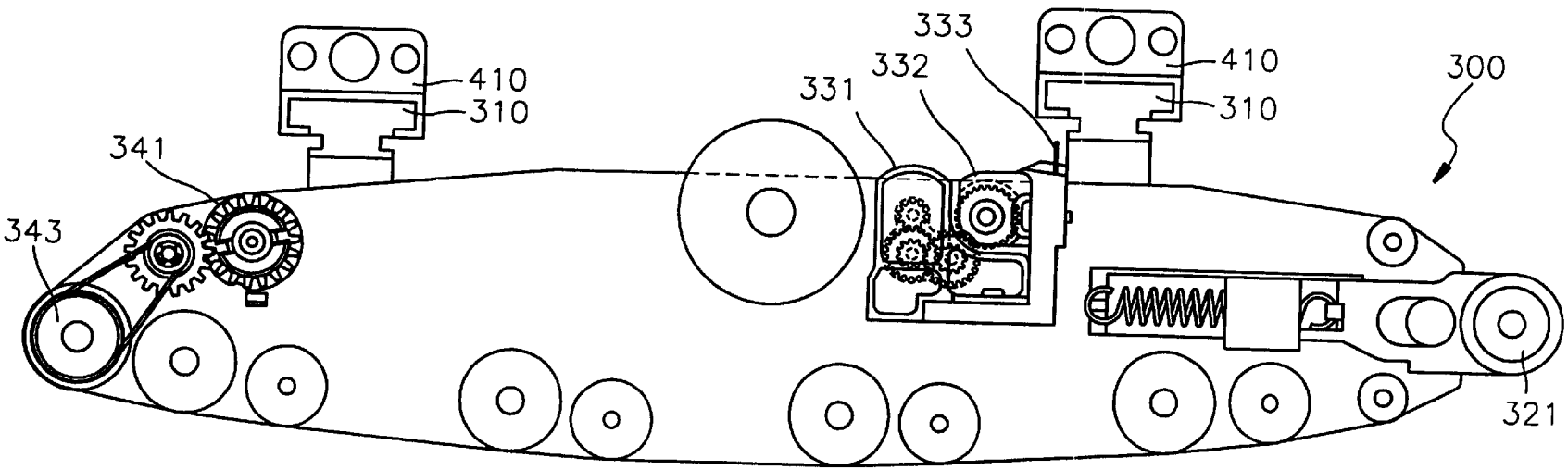
FIG. 17 is a diagram illustrating a belt unit when a photosensitive belt is removed.
Figure 18:
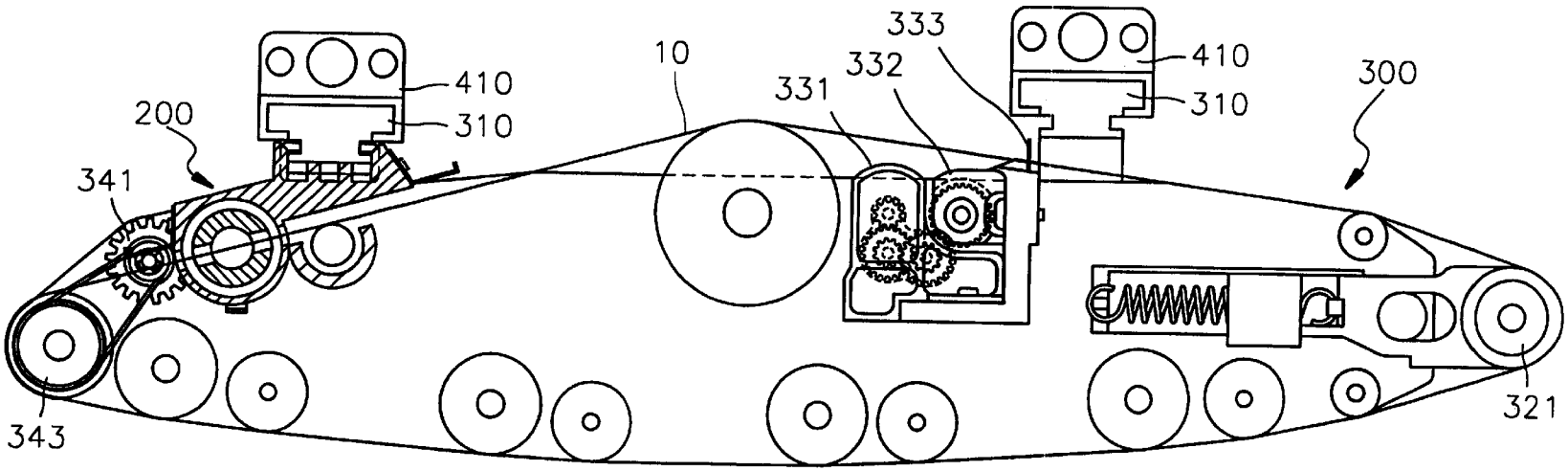
FIG. 18 is a diagram illustrating a belt unit when a photosensitive belt is installed.
Figure 19:
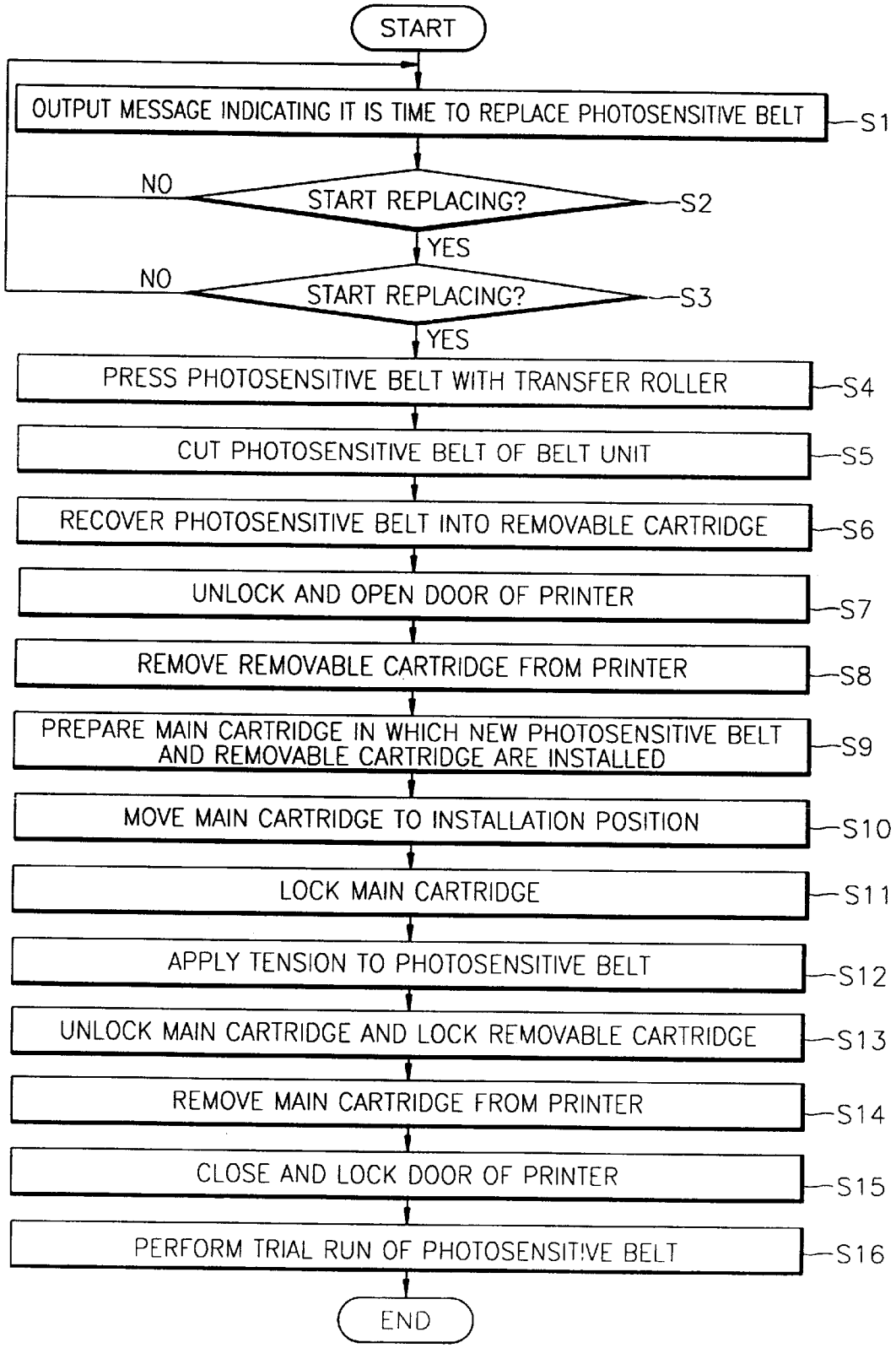
FIG. 19 is a flow chart illustrating the steps of a photosensitive belt replacing method according to the present invention.

The photosensitive belt replacing operation which utilizes the photosensitive belt cartridge and the photosensitive belt replacing apparatus described thus far part by part is carried out according to the flow chart of FIG. 19. First, when the time comes to replace the photosensitive belt, the printer informs a user that it is time to replace the photosensitive belt by, for example, a display of the printer (S1). This step is performed by using a usual counter which can count the number of prints, measuring the number, and causing the printer to automatically output a message when a predetermined number is reached. The user selects whether the user starts to replace the photosensitive belt in connection with the message (S2), and then again the user is subjected to at least one confirmation step of the above step (S3). The confirmation step is intended to prevent a possible accident of an unwanted operation, and is a precaution against careless selection of replacing the photosensitive belt notwithstanding the user not wanting to replace the photosensitive belt. Therefore, after a predetermined plurality of confirmation steps are performed, the photosensitive belt replacing operation can be started. When the user selects the start of replacing the photosensitive belt, first the belt cutting means cuts the photosensitive belt. At this time, since the photosensitive belt can be cut well when the photosensitive belt is tensioned tightly, the steering roller 321 is still maintained at the tensioned position, and a transfer roller 14*a* (FIG. 1) is positioned to press the photosensitive belt so that skewing of the photosensitive belt can be minimized during cutting (S4). In this state, the cutting blade 333 cuts the photosensitive belt widthwise by rotating the above-described lead screw 334 of FIG. 16 to move the movable block 332 (S5). Thereafter, the transfer roller 14*a* is separated from the photosensitive belt 10, and then the drive roller 343 is rotated in a direction opposite to that of the circulation of the photosensitive belt 10, as described with reference to FIG. 15. Accordingly, the revolver 220 mechanically connected to the drive roller 343 via the first and second gears 342 and 342 is rotated, the revolver 220 winds the photosensitive belt 10 between the inner circumferential surface of the cylinder 210 and the outer circumferential surface thereof, as described above with reference to FIG. 4C (S6). When thus all the photosensitive belt 10 is wound into the cylinder 210, the steering roller 321 is moved to the position shown in FIG. 10A, i.e., the position in which the steering roller 321 does not apply a tension to the photosensitive belt 10. Accordingly, the first and second lever 351 and 352 are moved in turn according to the movement of the steering roller 321, the pivoting piece 353 returns to the position in which the pivoting piece 353 can be locked again into the hooking recess 131 of the locking projection 130, and the locking piece 352*a* is freed from the groove 201 of the cylinder 210, as shown in FIG. 10B. In this state, when a door (not shown) of the printer is unlocked and opened (S8), and then the removable cartridge 200 is pulled, the removable cartridge 200 is slid on the insertion rails 310 and removed from the printer (S8). In addition, the above-described second gear 342 is stopped after being adjusted to be at the initial position by the sensor 345 and the groove 342*c* for adjusting the position of the second gear 342 so that again the cameo portion 223 of a next new revolver 220 can be exactly mated with the intaglio portion 342*b* of the second gear 342. Thus, the removal of the photosensitive belt 10 is completed, and the printer is in a state waiting for installation of a new photosensitive belt, as shown in FIG. 17.

Then, in order to install a new photosensitive belt, a main cartridge 100 in which the new photosensitive belt is received is prepared (S9). A removable cartridge 200 is assembled in the main cartridge 100, as shown in FIG. 8, and the photosensitive belt received in the main cartridge 100 is supported as a continuous loop belt inserted between the magnets 140 and the plate members 150. When the main cartridge 100 is inserted in the printer, the guide rails 120 and 126 are fitted to the insertion rails 310 of the belt unit 300, and then the main cartridge 100 is pushed into the printer (S10). Of course, since the above-described transfer roller 14*a* (FIG. 1) is raised before the step S10 so that the transfer roller 14*a* is spaced by a predetermined gap from the position closely contacting the photosensitive belt, the main cartridge 100 does not interfere with the transfer roller 14*a*. When the photosensitive belt cartridge is thus inserted into the printer, the cameo portion 223 of the revolver 220 is mated with the intaglio portion 342*b* of the second gear 342, and in addition the hook portion 353*a* of the pivoting piece 353 hooks the hooking recess 131 of the locking projection 130 elastically, as shown in FIG. 10A, and the main cartridge 100 is locked in the printer (S11). At this time, a switch (sw) installed to contact the pivoting piece 353 senses the installation of the photosensitive belt cartridge. In this state, in order to separate the photosensitive belt from the main cartridge 100, the steering roller 321 is moved, as shown in FIG. 11A to cause a tight tension to be applied to the photosensitive belt (S12). In addition, in order to move the steering roller 321 thus, the link members 325 are pivoted, and accordingly the first and second levers 351 and 352 are moved relatedly with the link members 325. In other words, the first lever 351 is pulled and the second lever 352 is pushed around the pivot 325*a*. Accordingly, as the first lever 351 and the pivoting piece 353 connected therewith rotate, the hook portion 353*a* of the pivoting piece 353 is freed from the hooking recess 131 of the locking projection 130, and the main cartridge 100 is unlocked. At the same time, the locking piece 352*a* connected with the second lever 352 is inserted into the groove 201 of the cylinder 210 of the removable cartridge 200, and the removable cartridge 200 is locked (S13). That is, though shown as two steps in FIG. 19, the application of a tension to the photosensitive belt inserted in the belt unit 300, and the unlocking of the main cartridge 100 and the locking of the removable cartridge 200 are performed simultaneously. In this state, since the photosensitive belt is bound to the belt unit 300 by the tension applied by the steering roller 321, and the removable cartridge 200 is locked by the locking piece 352*a*, when the main cartridge 100 is pulled out again, only the main cartridge 100 is removed from the printer with the photosensitive belt and the removable cartridge 200 remaining in the belt unit 300 (S14). Thereafter, when the door of the printer is closed and locked, the installation operation of the photosensitive belt is completed (S15). In addition, while trial runs of the newly installed photosensitive belt are performed before a normal printing job is performed, it is confirmed that the photosensitive belt is properly installed (S16).

As described above, when the operation of replacing a photosensitive belt is performed by using a photosensitive belt cartridge and a photosensitive belt replacing apparatus of an electrophotographic printer according to the present invention, since the operation is nearly automatically performed except for the cartridge being pushed and pulled by a user, the replacing operation can be very conveniently performed in a relatively short time, and therefore the photosensitive belt always can be installed at an exact position regardless of the expertise of the user.

What is claimed is:

1. A photosensitive belt cartridge of an electrophotographic printer for receiving a photosensitive belt to be installed in the electrophotographic printer, comprising:

a main cartridge which has a hollow shape, one side surface of which is open, and in which the photosensitive belt is received as a continuous loop belt; and a removable cartridge removably assembled to the main cartridge so that when the photosensitive belt is installed at a circulation position in the printer, the removable cartridge is operative to be separated from the main cartridge and installed with the photosensitive belt in the printer, and provided with a belt recovering mechanism therein for winding the photosensitive belt from the circulation position when necessary.

2. The photosensitive belt cartridge as claimed in claim 1, wherein the belt recovering mechanism includes:

a hollow cylinder through a circumferential wall of which first slots are formed so that the photosensitive belt is operative to pass through the first slots; and a revolver which is rotatably installed in the hollow cylinder, through which a second slot is formed corresponding to the first slots so that the photosensitive belt passes therethrough, and which, when rotated, rotates with the photosensitive belt passing through the second slot, and therefore winds the photosensitive belt between an outer circumferential surface of the revolver and an inner circumferential surface of the hollow cylinder.

3. The photosensitive belt cartridge as claimed in claim 2, wherein the photosensitive belt cartridge further comprises an initial position fixing mechanism which aligns an initial position of the second slot with the first slots and fixes the position.

4. The photosensitive belt cartridge as claimed in claim 3, wherein the initial position fixing mechanism includes:

first and second through holes formed at the cylinder and the revolver, respectively, so as to be overlapped when the first and second slots are aligned with the initial position to be able to pass the photosensitive belt therethrough; and a fixing pin operative to be projected from the main cartridge so as to be inserted into the first and second through holes when the removable cartridge is assembled to the main cartridge, and thus preventing the rotation of the revolver.

5. The photosensitive belt cartridge as claimed in claim 2, wherein a cameo portion for coupling is provided at a leading end of the revolver and is projected so that the revolver can be mated with the power transferring portion provided at the printer when the removable cartridge is separated from the main cartridge and installed in the printer.

6. The photosensitive belt cartridge as claimed in claim 1, wherein the photosensitive belt cartridge further comprises contacting members intermittently installed at a plurality of positions along a continuous loop path of the photosensitive belt within the main cartridge for causing the photosensitive belt to contact an inner circumferential surface of the main cartridge.

7. A The photosensitive belt cartridge as claimed in claim 6, wherein the contacting members include:

a plurality of magnets intermittently embedded in an inner circumferential wall of the main cartridge along the continuous loop path of the photosensitive belt; and a plurality of plate members, each one end of which is fixed to the inner circumferential wall of the main cartridge and the other end of which is magnetically attached to the corresponding magnet so that the photosensitive belt is inserted and supported between the magnets and the plate members.

8. The photosensitive belt cartridge as claimed in claim 1, wherein the photosensitive belt cartridge further comprises guide rails provided at the main cartridge and the removable cartridge, respectively, and slidably mated with insertion rails provided at the printer so that the guide rails are operative to move into the installation position of the photosensitive belt along the insertion rails.

9. The photosensitive belt cartridge as claimed in claim 8, wherein the guide rails are provided on upper surfaces of the main cartridge and the removable cartridge, respectively, are provided with hanging fibs extended in parallel with a direction of moving into the printer and are mated with the insertion rails in a manner of hanging on the insertion rails, and the hanging ribs are partially cut at the ends of the guide rails which are mated with the insertion rails.

10. The photosensitive belt cartridge as claimed in claim 1, wherein the photosensitive belt cartridge further comprises a grounding member which grounds the photosensitive belt to a grounding portion provided in the printer.

11. The photosensitive belt cartridge as claimed in claim 10, wherein the grounding member comprises:

a grounding brush installed at the removable cartridge so as to contact one end portion of the photosensitive belt; and a contacting portion electrically connected to the grounding brush and provided at the removable cartridge so as to contact the grounding portion when the photosensitive belt is installed at the circulation position within the printer.

12. A photosensitive belt replacing apparatus of an electrophotographic printer for replacing a photosensitive belt installed in a belt unit of the printer comprising:

a main cartridge receiving the photosensitive belt to be replaced and installed as a continuous loop belt, and allowing the received photosensitive belt to be installed in the belt unit by being moved into an installation position of the photosensitive belt within the printer while hanging on and sliding along insertion rails provided at the belt unit;

a belt separating mechanism installed at the belt unit, and binding the photosensitive belt to the belt unit by applying a tight tension to the photosensitive belt of the main cartridge moved into the installation position and therefore allowing the photosensitive belt to remain installed in the belt unit when the main cartridge is removed from the installation position;

a belt cutting mechanism installed in the printer and which cuts the photosensitive belt which has been installed in the belt unit as a continuous loop belt and has been used so that the photosensitive belt can be removed; and a belt recovering mechanism which winds the photosensitive belt cut by the belt cutting mechanism and removes the photosensitive belt from the belt unit.

13. The photosensitive belt replacing apparatus of an electrophotographic printer as claimed in claim 12, wherein the belt cutting mechanism includes:

a driving unit provided in the printer; and a cutting blade for cutting the photosensitive belt while operated by the driving unit and moved across the photosensitive belt widthwise.

14. The photosensitive belt replacing apparatus of an electrophotographic printer as claimed in claim 13, wherein the driving unit includes:

a driving motor;

a lead screw disposed in parallel with a widthwise direction of the photosensitive belt and rotated by the driving motor; and a movable block on which the cutting blade is installed and which is mechanically connected to the lead screw and moves across the photosensitive belt in the widthwise direction of the photosensitive belt according to the rotation of the lead screw.

15. The photosensitive belt replacing apparatus of an electrophotographic printer as claimed in claim 12, wherein the belt recovering mechanism includes:

a removable cartridge removably assembled to the main cartridge so as to be separated from the main cartridge and installed in the printer when the photosensitive belt is installed; and comprising a hollow cylinder through a circumferential wall of which first slots are formed so that the photosensitive belt is operative to pass through the first slots; and a revolve which is rotatably installed in the hollow cylinder, through which a second slot is formed corresponding to the first slots so that the photosensitive belt passes therethrough, and which, when being rotated, rotates with the photosensitive belt passing through the second slot, and therefore winds the photosensitive belt between an outer circumferential surface of the revolver and an inner circumferential surface of the hollow cylinder;

a revolver driving source installed in the printer and connected to the revolver via a predetermined coupler when the removable cartridge is installed in the printer for transferring rotation power to the revolver; and a removable cartridge locking mechanism which locks the removable cartridge in place when the removable cartridge is installed in the printer and holds the removable cartridge so that the removable cartridge can be separated from the main cartridge when the main cartridge is removed from the printer.

16. The photosensitive belt replacing apparatus of an electrophotographic printer as claimed in claim 15, wherein the coupler comprises a cameo portion and an intaglio portion which are complementarily formed at one end of the revolver and the revolver driving source side, respectively, so that the cameo portion and the intaglio portion are mated with each other as the removable cartridge is moved in the printer.

17. The photosensitive belt replacing apparatus of an electrophotographic printer as claimed in claim 15, wherein the removable cartridge locking mechanism includes:

a groove formed at the outer circumferential surface of the removable cartridge; and a locking piece provided at the belt unit so as to be inserted into the groove according to the motion of the belt separating mechanism applying a tension to the photosensitive belt in the main cartridge.

18. The photosensitive belt replacing apparatus of an electrophotographic printer as claimed in claim 12, wherein the belt separating mechanism includes a steering roller rotatably and movably installed at the belt unit and supporting the circulation of the photosensitive belt, and a slide mechanism selectively applying a tension to the photosensitive belt by moving the steering roller by a predetermined distance; and is operative to allow the photosensitive belt to remain in the circulation path of the photosensitive belt in the belt unit when the main cartridge is removed out of the printer in a state in which the steering roller applies a tension to the photosensitive belt received in main cartridge.

19. The photosensitive belt replacing apparatus of an electrophotographic printer as claimed in claim 12, wherein the photosensitive belt replacing apparatus further comprises a main cartridge locking mechanism which locks the main cartridge moved in the printer to not move, and unlocks the main cartridge when the main cartridge is removed out of the printer after the photosensitive belt is installed in the belt unit.

20. The photosensitive belt replacing apparatus of an electrophotographic printer as claimed in claim 19, wherein the main cartridge locking mechanism includes:

a locking projection formed to be projected from an inner side of the main cartridge and provided with a predetermined hooking recess; and a pivoting piece pivotably installed at the belt unit and connected to the belt separating mechanism so as to be elastically hooked in the hooking recess while being pivoted by the interference with the locking projection according to the insertion of the main cartridge and to be freed back from the hooking recess according to the motion of the belt separating mechanism applying a tension to the photosensitive belt within the main cartridge.

21. A method of replacing a photosensitive belt of an electrophotographic printer for replacing the photosensitive belt which circulates around a continuous loop track while supported by a belt unit within the printer, and on which a predetermined image is developed by a developing unit and which transfers the image to a transfer unit, said method comprising the steps of removing the photosensitive belt installed in the belt unit, and installing a new photosensitive belt in the belt unit, wherein the removing step includes the steps of:

outputting a message informing a user that it is time to replace the photosensitive belt;

confirming whether the user wishes to start replacing the photosensitive belt;

cutting the photosensitive belt by moving a cutting blade installed in the printer so as to move across the photosensitive belt when the user selects start of replacement of the photosensitive belt;

driving a removable cartridge provided with a hollow cylinder and a revolver rotatably installed in the hollow cylinder and installed in the belt unit to move and causing the revolver to wind the cut photosensitive belt between an outer circumferential surface of the revolver and an inner surface of the cylinder according to the rotation of the revolver; and removing the removable cartridge having wound the photosensitive belt from the printer.

22. The method of replacing a photosensitive belt of an electrophotographic printer as claimed in claim 21, wherein the confirming step includes at least one step of reconfirming whether the user wishes to start replacing the photosensitive belt.

23. The method of replacing a photosensitive belt of an electrophotographic printer as claimed in claim 21, wherein the method further includes the step of pressing and supporting the photosensitive belt supported in the belt unit with a transfer roller of the transfer unit before the cutting step.

24. The method of replacing a photosensitive belt of an electrophotographic printer as claimed in claim 21, wherein the cutting step is performed with the photosensitive belt applied with a tension.

25. The method of replacing a photosensitive belt of an electrophotographic printer as claimed in claim 21, wherein the method further includes the step of confirming whether the photosensitive belt is normally installed while circulating the photosensitive belt after the new photosensitive belt and removal cartridge are installed in the belt unit.

26. The method of replacing a photosensitive belt of an electrophotographic printer as claimed in claim 21, wherein the installing step includes the steps of:

preparing a main cartridge in which the new photosensitive belt is received as a continuous loop belt and to which a new removable cartridge to be installed in the belt unit is removably assembled together with the photosensitive belt;

inserting the main cartridge into an installation position in the printer;

locking the main cartridge to the installation position;

fitting the received photosensitive belt to the belt unit by moving a steering roller installed in the belt unit and applying a tight tension to the photosensitive belt received in the main cartridge;

unlocking the main cartridge and locking the removable cartridge;

causing the photosensitive belt and the removable cartridge to be separated from the main cartridge and to remain installed in the belt unit when the main cartridge is removed from the printer.

27. The method of replacing a photosensitive belt of an electrophotographic printer as claimed in claim 26, wherein the confirming step includes at least one step of reconfirming whether the user wishes to start replacing the photosensitive belt.

28. The method of replacing a photosensitive belt of an electrophotographic printer as claimed in claim 26, wherein the method further includes the step of pressing and supporting the photosensitive belt supported in the belt unit with a transfer roller of the transfer unit before the cutting step.

29. The method of replacing a photosensitive belt of an electrophotographic printer as claimed in claim 26, wherein the cutting step is performed with the photosensitive belt applied with a tension.

30. The method of replacing a photosensitive belt of an electrophotographic printer as claimed in claim 26, wherein the method further includes the step of confirming whether the photosensitive belt is normally installed while circulating the photosensitive belt after the new photosensitive belt and removal cartridge are installed in the belt unit.

31. A method of replacing a photosensitive belt of an electrophotographic printer for replacing the photosensitive belt which circulates around a continuous loop track while supported by a belt unit within the printer, and on which a predetermined image is developed by a developing unit and which transfers the image to a transfer unit said method comprising the steps of removing the photosensitive belt installed in the belt unit, and installing a new photosensitive belt in the belt unit, wherein the installing step includes the steps of:

preparing a main cartridge in which the new photosensitive belt is received as a continuous loop belt and to which a new removable cartridge to be installed in the belt unit is removably assembled together with the photosensitive belt;

inserting the main cartridge into an installation position in the printer;

locking the main cartridge to the installation position;

fitting the received photosensitive belt to the belt unit by moving a steering roller installed in the belt unit and applying a tight tension to the photosensitive belt received in the main cartridge;

unlocking the main cartridge and locking the removable cartridge;

causing the photosensitive belt and the removable cartridge to be separated from the main cartridge and to remain installed in the belt unit when the main cartridge is removed from the printer.

32. The method of replacing a photosensitive belt of an electrophotographic printer as claimed in claim 31, wherein the method further includes the step of confirming whether the photosensitive belt is normally installed while circulating the photosensitive belt after the new photosensitive belt and removal cartridge are installed in the belt unit.

* * * * *